US012758003B2

(12) United States Patent
Ji et al.

(10) Patent No.: US 12,758,003 B2
(45) Date of Patent: Oct. 13, 2026

(54) ORAL CARE IMPLEMENT, HANDLE THEREOF, AND ORAL CARE REFILL HEAD THEREFOR

(71) Applicant: Colgate-Palmolive Company, New York, NY (US)

(72) Inventors: Yanmei Ji, Jiangsu (CN); Xiangji Ding, YangZhou City (CN); Al Aquanza Sprosta, Maplewood, NJ (US); Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 659 days.

(21) Appl. No.: 18/258,309

(22) PCT Filed: Dec. 22, 2020

(86) PCT No.: PCT/CN2020/138181
§ 371 (c)(1),
(2) Date: Jun. 19, 2023

(87) PCT Pub. No.: WO2022/133696
PCT Pub. Date: Jun. 30, 2022

(65) Prior Publication Data

US 2024/0032678 A1 Feb. 1, 2024

(51) Int. Cl.
*A46B 5/00* (2006.01)
*A46B 7/04* (2006.01)

(52) U.S. Cl.
CPC ..... *A46B 5/0095* (2013.01); *A46B 7/042* (2013.01)

(58) Field of Classification Search
CPC ..... A46B 7/04; A46B 7/042; A46B 5/0095; A61C 17/222
See application file for complete search history.

(56) References Cited

U.S. PATENT DOCUMENTS 3,369,265 A 2/1968 Halberstadt et al.
4,811,445 A 3/1989 Lagieski et al.
(Continued)

FOREIGN PATENT DOCUMENTS

CH 391652 5/1965
CN 103648434 3/2014
(Continued)

OTHER PUBLICATIONS

Colgate Keep Toothbrush, announced 2021 [online], [site visited Mar. 5, 2021]. Available from internet, URL: https://www.amazon.com/Colgate-Manual-Toothbrush-Clean-Starter/dp/B08QR6D6SQ/ref=sr_1_1 (Year:2021).
(Continued)

*Primary Examiner* — Shay Karls

(57) ABSTRACT

An oral care implement (1000) that includes a handle (100) and an oral care refill head (200). The oral care refill head (200) is alterable between a first state in which it is separated from the handle (100) and a second state in which it is coupled to the handle (100) by inserting a stem (120) of the handle (100) inside of a cavity (221) of the oral care refill head (200). The oral care refill head (200) has at least one alignment groove (250, 260) that receives at least one alignment rib of the stem (120) of the handle (100). Furthermore, the stem (120) and the oral care refill head (200) include snap lock features that form a snap-fit interlock to secure the oral care refill head (200) to the handle (100).

20 Claims, 13 Drawing Sheets

(56) References Cited

U.S. PATENT DOCUMENTS

| | | | | |
|---|---|---|---|---|
| 4,827,550 | A | 5/1989 | Graham et al. | |
| 5,365,627 | A | 11/1994 | Jousson et al. | |
| 6,161,244 | A | 12/2000 | Jeannet et al. | |
| 6,785,926 | B2 | 9/2004 | Green | |
| D517,213 | S | 3/2006 | Vu et al. | |
| D517,325 | S | 3/2006 | Black et al. | |
| D617,564 | S | 6/2010 | Nanda | |
| 8,196,246 | B1 | 6/2012 | Haynes | |
| D724,845 | S | 3/2015 | Yoshida et al. | |
| 9,168,117 | B2 | 10/2015 | Yoshida et al. | |
| D749,851 | S | 2/2016 | Watkins | |
| D762,986 | S | 8/2016 | May et al. | |
| D769,626 | S | 10/2016 | Bloch et al. | |
| D788,469 | S | 6/2017 | McGarry et al. | |
| D798,060 | S | 9/2017 | Shigeno | |
| 9,775,693 | B2 | 10/2017 | Fattori | |
| D844,995 | S | 4/2019 | Wong et al. | |
| D853,732 | S | 7/2019 | Wainless et al. | |
| D855,998 | S | 8/2019 | Hielscher et al. | |
| D869,855 | S | 12/2019 | Khayat | |
| 10,603,147 | B2 | 3/2020 | Bloch et al. | |
| 10,603,150 | B2 | 3/2020 | Bloch et al. | |
| 10,639,133 | B2 | 5/2020 | Bloch et al. | |
| D886,459 | S | 6/2020 | Yuan | |
| D886,460 | S | 6/2020 | Xi et al. | |
| D888,435 | S | 6/2020 | Damavandi et al. | |
| 10,667,892 | B2 | 6/2020 | Bartschi et al. | |
| D890,296 | S | 7/2020 | Chandler | |
| 10,709,533 | B2 | 7/2020 | Bloch et al. | |
| D899,094 | S | 10/2020 | Wainless et al. | |
| 10,792,136 | B2 | 10/2020 | May et al. | |
| D901,777 | S | 11/2020 | Gentile | |
| 10,864,065 | B2 | 12/2020 | Fritsch et al. | |
| D907,924 | S | 1/2021 | Wong et al. | |
| 10,898,304 | B2 | 1/2021 | Yoshida et al. | |
| D912,988 | S | 3/2021 | Langhammer | |
| D922,775 | S | 6/2021 | Albay et al. | |
| D929,131 | S | 8/2021 | Sprosta et al. | |
| D950,956 | S | 5/2022 | Gatzemeyer et al. | |
| D961,267 | S | 8/2022 | Ji et al. | |
| D985,278 | S | 5/2023 | Sprosta | |
| 2014/0115801 | A1 | 5/2014 | Haynes et al. | |
| 2014/0143963 | A1 | 5/2014 | Fattori | |
| 2014/0150190 | A1 | 6/2014 | Fattori | |
| 2014/0165312 | A1 | 6/2014 | Fattori | |
| 2017/0151044 | A1 | 6/2017 | Okai | |
| 2018/0296309 | A1* | 10/2018 | Yoshida | A61C 17/3481 |
| 2018/0368960 | A1 | 12/2018 | Fritsch et al. | |
| 2019/0175322 | A1 | 6/2019 | Bloch et al. | |
| 2019/0200743 | A1 | 7/2019 | Jungnickel | |
| 2019/0231063 | A1 | 8/2019 | May et al. | |
| 2021/0368973 | A1* | 12/2021 | Sprosta | A46B 7/042 |

FOREIGN PATENT DOCUMENTS

| | | |
|---|---|---|
| CN | 103889365 | 6/2014 |
| CN | 104135964 | 11/2014 |
| CN | 104837439 | 8/2015 |
| CN | 105188471 | 12/2015 |
| CN | 304364633 | 11/2017 |
| CN | 108113189 | 6/2018 |
| CN | 108471869 | 8/2018 |
| CN | 304861872 | 10/2018 |
| CN | 109907851 | 6/2019 |
| CN | 110025390 | 7/2019 |
| CN | 305299010 | 8/2019 |
| CN | 305410234 | 10/2019 |
| CN | 305429205 | 11/2019 |
| DE | 202010013214 | 2/2011 |
| EP | 2797550 B1 | 9/2016 |
| FR | 2325335 | 6/1982 |
| FR | 2476994 | 2/1984 |
| GB | 914844 | 1/1963 |
| JP | H60112926 | 7/1985 |
| JP | H06-042661 | 11/1994 |
| JP | H08-299372 | 11/1996 |
| JP | H09-019445 | 1/1997 |
| JP | H10-023928 | 1/1998 |
| JP | 2005-296515 | 10/2005 |
| JP | 2011-139844 | 7/2011 |
| JP | 2011-143057 | 7/2011 |
| KR | 20130095821 | 8/2013 |
| KR | 101528395 | 6/2015 |
| WO | 2011132878 | 10/2011 |
| WO | 2014/093059 | 6/2014 |
| WO | 2018/098211 | 5/2018 |
| WO | 2021/102612 | 6/2021 |
| WO | 2022/133696 | 6/2022 |

OTHER PUBLICATIONS

International Search Report and the Written Opinion of the International Searching Authority issued in International Application PCT/CN2020/138181 mailed Sep. 24, 2021.

International Search Report and Written Opinion of the International Searching Authority in International Application No. PCT/CN2019/120512, mailed Aug. 28, 2020.

Taiwan Patent Office (TIPO) Search Report dated Nov. 29, 2020 issued in TW Patent Appln. No. 109302517; pp. 1-2, including English translation.

Taiwan Patent Office (TIPO) Search Report dated Nov. 29, 2020 issued in TW Patent Appln. No. 109302518; pp. 1-2, including English translation.

* cited by examiner

ORAL CARE IMPLEMENT, HANDLE THEREOF, AND ORAL CARE REFILL HEAD THEREFOR

BACKGROUND

Toothbrushes having replaceable heads have been used for many years, enabling users to replace the head of the toothbrush for continued use with the same handle. This is often used for electric toothbrushes because the expensive electronic circuitry is stored in the handle making it cost-prohibitive to have to dispose of the handle each time that the cleaning elements on the head have worn out and require replacement. However, there are also manual toothbrushes in existence that utilize a replaceable head, which can be beneficial to the environment, for example, because less plastic waste is being added to the landfills when only the head is being replaced every three months or so. There is a continuing need for an improvement in the connection mechanism between the handle and the replaceable heads configured to be attached thereto.

SUMMARY

The present invention is directed to an oral care implement that includes a handle and an oral care refill head. The oral care refill head is alterable between a first state in which it is separated from the handle and a second state in which it is coupled to the handle by inserting a stem of the handle inside of a cavity of the oral care refill head. The oral care refill head at least one alignment groove that receive at least one alignment rib of the stem of the handle. Furthermore, the stem and refill head include snap lock features that form a snap-fit interlock to secure the oral care refill head to the handle.

In one aspect, the invention may be an oral care implement comprising: a handle comprising: a gripping portion having a distal end; and a stem extending from the distal end of the gripping portion along a stem axis, the stem comprising: a first axial section extending axially from the distal end of the gripping portion; a second axial section extending axially from the first axial section, the second axial section comprising a lower end surface that protrudes outwardly from the first axial section in a direction away from the stem axis to form a downwardly facing shoulder; a first alignment element protruding from and extending axially along the outer surface of the first axial section and terminating at a distal end that is axially spaced apart from the lower end surface of the second axial section; an oral care refill head comprising: an oral care treatment portion; and a sleeve portion comprising an inner surface that defines a sleeve cavity extending along a cavity axis and a proximal edge surface that defines an opening into the sleeve cavity, the sleeve cavity comprising a first alignment groove formed into the inner surface and a snap element; the oral care refill head alterable between: a first state in which the oral care refill head is separated from the handle; and a second state in which the stem of the handle is disposed within the sleeve cavity of the sleeve portion so that the proximal edge surface of the oral care refill head is adjacent the distal end of the gripping portion of the handle and the first alignment element of the handle nests within the first alignment groove of the oral care refill head, the oral care refill head secured to the handle by an engagement between the snap element of the oral care refill head and the downwardly facing shoulder of the stem.

In another aspect, the invention may be an oral care implement handle for detachably coupling to an oral care refill head, the oral care implement handle comprising: a gripping portion having a distal end; and a stem extending along a stem axis and protruding from the distal end of the gripping portion, the stem comprising: a first axial section extending from the distal end of the gripping portion; a second axial section extending axially from the first axial section, a lower end surface of the second axial section protruding outwardly from the first axial section to form a downwardly facing shoulder; a first alignment rib protruding from and extending axially along the outer surface of the first axial section, a distal end of the first alignment rib being axially spaced apart from the downwardly facing shoulder of the second axial section.

In yet another aspect, the invention may be an oral care implement handle for detachably coupling to an oral care refill head, the oral care implement handle comprising: a gripping portion having a distal end; and a stem extending along a stem axis and protruding from the distal end of the gripping portion, the stem comprising: a stem body comprising an outer surface; a first alignment rib protruding from and extending axially along the outer surface of the stem body on a first side of the stem axis, an outer surface of the first alignment element extending along a first alignment axis that intersects the stem axis at a first angle; and a second alignment rib protruding from and extending axially along the outer surface of the stem body on a second side of the stem axis that is opposite the first side of the stem axis, an outer surface of the second alignment element extending along a second alignment axis that intersects the stem axis at a second angle that is greater than the first angle.

In a further aspect, the invention may be an oral care refill head for detachable coupling to a stem of a handle, the oral care refill head comprising: an oral care treatment portion; and a sleeve portion comprising: an inner surface that defines a sleeve cavity extending along a cavity axis; a sleeve snap element protruding from the inner surface towards the cavity axis and configured to snap-interlock with a stem snap element of the stem; a first alignment groove formed into the inner surface on a first side of the cavity axis, wherein a first reference plane that is transverse to the stem axis intersects both the first alignment groove and the sleeve snap element; and a second alignment groove formed into the inner surface on a second side of the cavity axis that is opposite the first side of the cavity axis, wherein the second alignment groove is not intersected by the first reference plane.

In a still further aspect, the invention may be an oral care refill head for detachable coupling to a stem of a handle, the oral care refill head comprising: an oral care treatment portion; and a sleeve portion comprising: an inner surface that defines a sleeve cavity extending along a cavity axis; a first alignment groove formed into the inner surface on a first side of the cavity axis, the first alignment groove comprising a floor portion that extends along a first groove axis that is oriented at a first angle relative to the cavity axis; and a second alignment groove formed into the inner surface on a second side of the cavity axis that is opposite the first side of the cavity axis, the second alignment groove comprising a floor portion that extends along a second groove axis that is oriented at a second angle relative to the cavity axis, the second angle being greater than the first angle.

In yet another aspect, the invention may be an oral care refill head for detachable coupling to a stem of a handle, the oral care refill head comprising: an oral care treatment portion; and a sleeve portion comprising: an inner surface that defines a sleeve cavity extending along a cavity axis; a sleeve snap element protruding from the inner surface towards the cavity axis and configured to snap-interlock with a stem snap element of the stem; and a first alignment groove formed into the inner surface, the first alignment groove comprising a floor portion that extends along a first groove axis that is oriented at an angle relative to the cavity axis.

In another aspect, the invention may be an oral care refill head for detachable coupling to a stem of a handle, the oral care refill head comprising: an oral care treatment portion comprising a plurality of tooth cleaning elements; and a sleeve portion comprising: an inner surface that defines a sleeve cavity extending along a cavity axis; a sleeve snap element positioned along the inner surface and configured to engage a stem snap element of the stem; and at least one alignment groove configured to receive a first alignment rib and a second alignment rib of the stem that are positioned 180° apart from one another, the at least one alignment groove comprising a first portion located on a first side of the cavity axis for receiving the first alignment rib and a second portion located on a second side of the cavity axis for receiving the second alignment rib.

The invention may be an oral care refill head including an oral treatment portion and a sleeve portion. Optionally, the sleeve portion may have an inner surface that defines a sleeve cavity extending along a cavity axis. Optionally, the sleeve portion may include a sleeve snap element protruding from the inner surface towards the cavity axis. The sleeve snap element may be configured to snap-fit interlock with a stem snap element of a stem of a handle that the oral care refill head is configured to be coupled to. Optionally, the sleeve portion may include a first alignment groove formed into the inner surface for receiving a first alignment rib of the stem of the handle. Optionally, the sleeve portion may include a second alignment groove formed into the inner surface for receiving a second alignment rib of the stem of the handle. Optionally, the first and second alignment grooves may extend along axes that are oblique to the cavity axis. The invention may include one or both of the alignment grooves in various different embodiments described herein.

The invention may be an oral care implement that includes the oral care refill head noted above and a handle. Optionally the handle may include a gripping portion and a stem. Optionally, the stem may include a first axial section that extends from the stem and a second axial section that extends from the first axial section. Optionally, a lower surface of the second axial section may protrude radially from the first axial section to form a downwardly facing shoulder that faces the gripping portion and is used for interlocking with the sleeve snap element of the oral care refill head. Optionally, the stem may include a first alignment element protruding from the outer surface thereof. Optionally, the stem may include a second alignment element protruding from the outer surface thereof. Optionally, the first and second alignment elements may be received in the first and second alignment grooves. The invention may include one or both of the alignment elements in various different embodiments described herein.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF DRAWINGS

The present invention will become more fully understood from the detailed description and the accompanying drawings, wherein.

DETAILED DESCRIPTION

Figure 1:
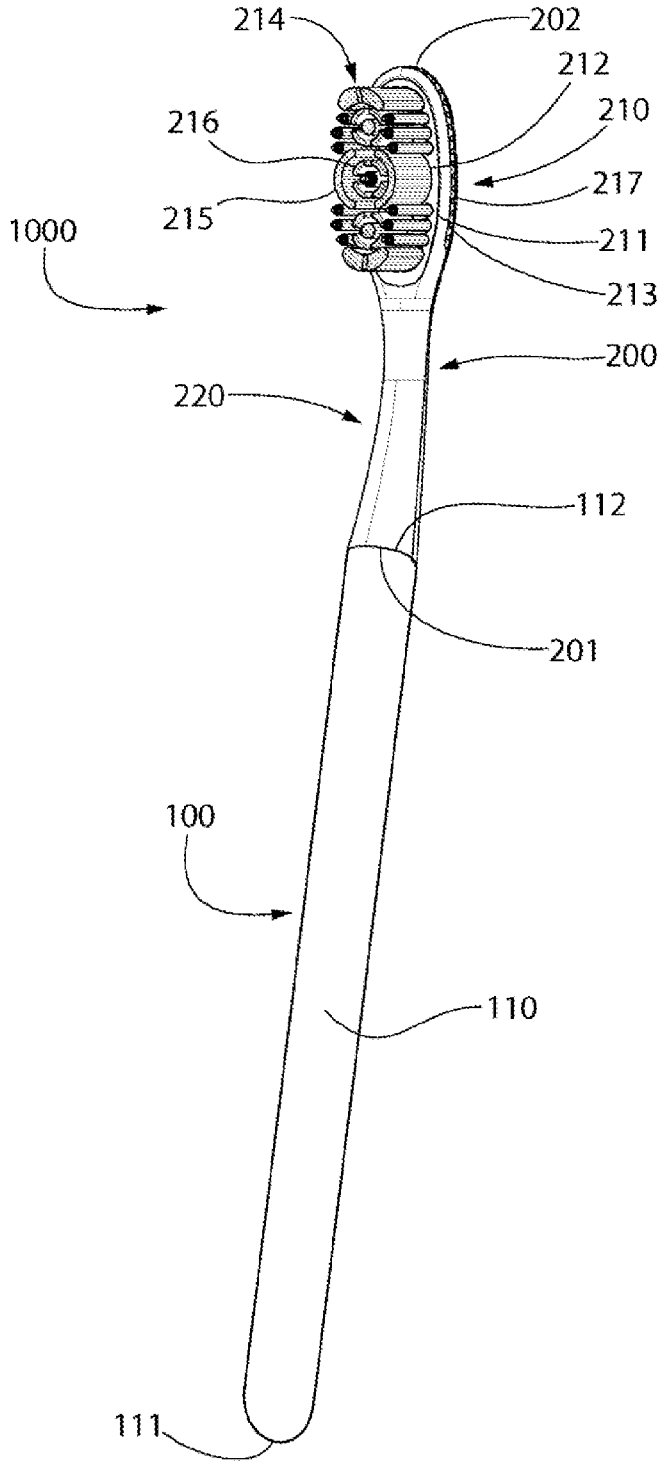
FIG. 1 is a perspective view of an oral care implement in accordance with an embodiment of the present invention, whereby a handle and an oral care refill head are in an attached state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
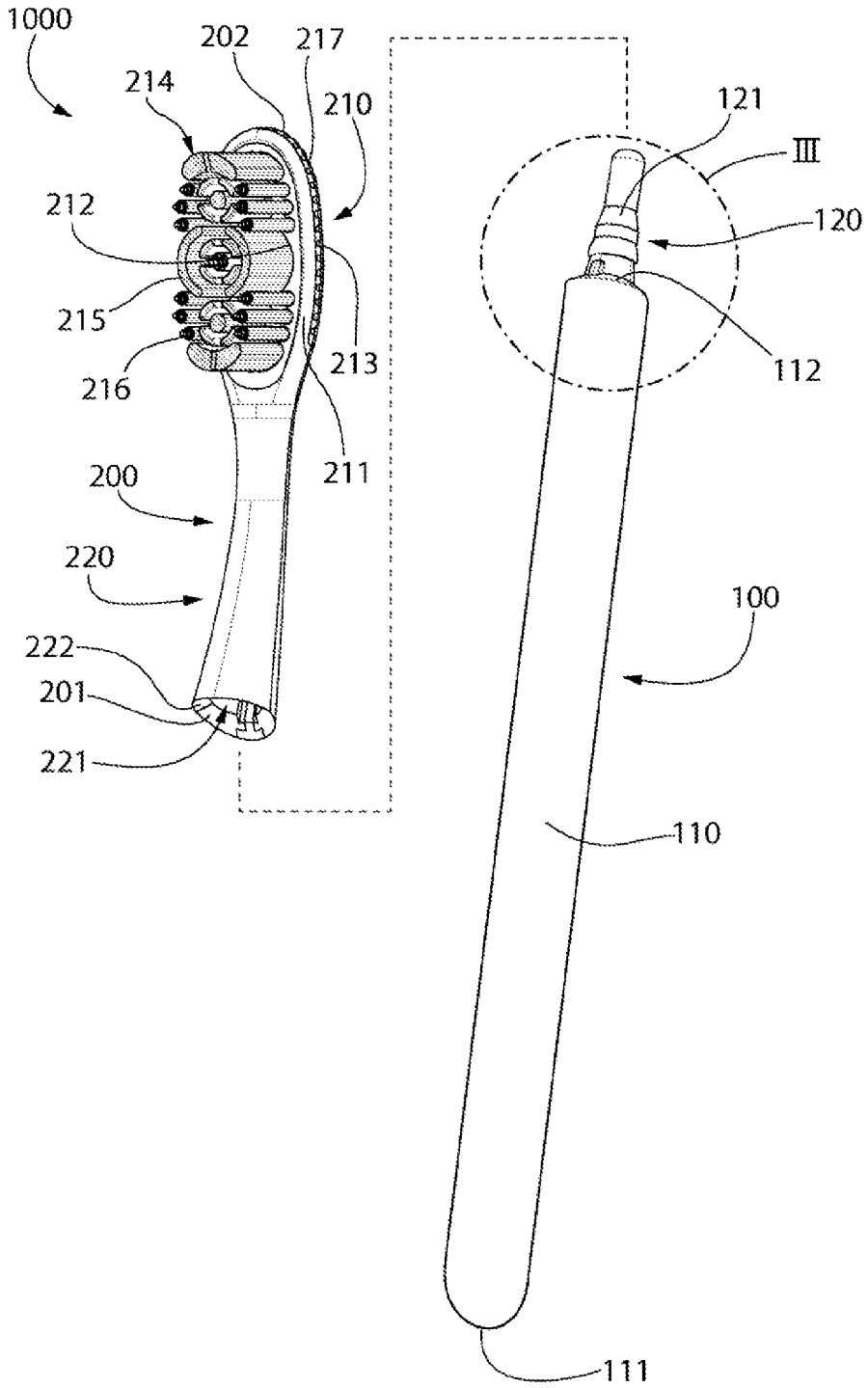
FIG. 2 is a perspective view of the oral care implement of FIG. 1 with the handle and the oral care refill head thereof in a detached state.

Referring first to FIGS. 1 and 2, an oral care implement 1000 is illustrated in accordance with an embodiment of the present invention. In the exemplified embodiment, the oral care implement 1000 is a manual toothbrush. However, the invention is not to be so limited in all embodiments and the oral care implement 1000 can take on other structural forms, including being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Furthermore, in still other embodiments the implement may not be specifically used for oral care, but could instead be a personal care implement which includes the various types of oral care implements noted herein and also includes hairbrushes, razors, body scrubbers, skin treatment devices, or the like. Thus, it is to be understood that the inventive concepts discussed herein can be applied to any type of oral care implement or personal care implement unless a specific type of implement is specified in the claims.

The oral care implement 1000 generally comprises a handle 100 and an oral care refill head 200. The handle 100 is the portion of the oral care implement 1000 that is gripped by a user during use of the oral care implement 1000 and the oral care refill head 200 is the portion of the oral care implement 1000 that includes a treatment portion for performing a treatment to the user, such as a cleaning of the oral cavity. The oral care refill head 200 is alterable between a first state in which the oral care refill head 200 is separated from the handle (as shown in FIG. 2) and a second state in which the oral care refill head 200 is coupled to the handle 100 (as shown in FIG. 1). Thus, the oral care refill head 200 is replaceable so that once the treatment portion thereof becomes worn, it can be replaced with a new oral care refill head by attaching the new oral care refill head to the same common handle 100. This may reduce costs and waste which consumers find desirable in today's climate.

The handle 100 generally comprises a gripping portion 110 extending from a proximal end 111 to a distal end 112 and a stem 120 extending or protruding from the distal end 112 of the gripping portion 110. The gripping portion 110 of the handle 100 is the portion that is typically gripped and manipulated by a user during use of the oral care implement 1000 to perform a treatment function. In the exemplified embodiment, the gripping portion 110 of the handle 100 has a round or circular/oval cross-sectional shape. However, the invention is not to be limited by this in all embodiments and the gripping portion 110 can take on any desired shape including having additional recesses, contours, or the like to enhance gripability. Thus, while the gripping portion 110 is generically depicted in the figures, the gripping portion 110 may take on any of a variety of different shapes in other embodiment. The stem 120 of the handle 100 is the portion that is used to couple the handle 100 to the oral care refill head 200, as will be described in much greater detail below. Thus, the stem 120 has features that facilitate the attachment of the handle 100 to the oral care refill head 200. The stem 120 comprises a stem body 121 having several different sections that serve different functions in achieving an acceptable coupling between the handle 100 and the oral care refill head 200.

In the exemplified embodiment, the stem 120 and the gripping portion 110 are integrally formed as a unitary and monolithic component in the exemplified embodiment. Thus, in the exemplified embodiment the entirety of the handle 100 is formed out of a first material. In some embodiments, the first material may have a first hardness. In some embodiments, the first material may be a metal or a metal alloy. In other embodiments the first material may be wood or a hard plastic. In other embodiments, the gripping portion 110 and the stem 120 may be formed from different materials. Thus, for example, the gripping portion 110 may be formed from metal or a metal alloy and the stem 120 may be formed from a hard plastic. In other embodiments, the gripping portion 110 may be formed from a hard plastic and the stem 120 may be formed from metal or a metal alloy. In still other embodiments, the gripping portion 110 may be formed from wood and the stem 120 may be formed from metal, metal alloys, hard plastic, or combinations thereof. Thus, some variation in the material used to form the different parts of the handle 100 may be possible in some embodiments.

The oral care refill head 200 comprises an oral care treatment portion 210 and a sleeve portion 220. The sleeve portion 220 comprises a sleeve cavity 221 that is configured to receive at least a portion of the stem 120 of the handle 100 for purposes of coupling the oral care refill head 200 to the handle 100. The oral care refill head 200 extends from a proximal end 201 that is formed by a proximal edge surface 222 of the sleeve portion 220 to a distal end 202 that is formed by a terminal end of the oral care treatment portion 210. The oral care treatment portion 210 comprises a head body 211 located at a distal end of the sleeve portion 220. The head body 211 may be integrally formed with the sleeve portion 220 as a monolithic component. The head body 211 and the sleeve portion 220 may be formed as an integral structure out of a hard plastic material such as polypropylene or polyethylene, although the invention is not to be so limited in all embodiments and the head body 211 and the sleeve portion 220 may be formed out of other materials in other embodiments including metal, wood, other hard plastics, or the like. The head body 211 has a front surface 212 facing a first direction and a rear surface 213 facing a second direction that is opposite the first direction. The oral care treatment portion 210 also comprises a plurality of tooth cleaning elements 214 protruding from the front surface 212 of the head body 211 in the first direction.

In the exemplified embodiment, the plurality of tooth cleaning elements 214 comprises a plurality of bristle tufts 215 and a plurality of elastomeric cleaning elements 216. The bristle tufts 215 and the elastomeric cleaning elements 216 collectively form a cleaning element field on the head body 211. The particular arrangement and/or pattern and/or location of the various bristle tufts 215 and elastomeric cleaning elements 216 is not to be limiting of the present invention in all embodiments. Thus, the bristle tufts 215 and the elastomeric cleaning elements 216 could be positioned at locations other than that which is depicted in the drawings. Furthermore, in some embodiments the oral care refill head 200 may include only bristle tufts 215 and none of the elastomeric cleaning elements 216, or vice versa. Thus, various permutations of the plurality of tooth cleaning elements 214 are possible within the scope of the invention described herein.

Furthermore, where it does not conflict with the other disclosure provided herein or the claims, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning element field in some embodiments. Furthermore, where bristles are used for one or more of the tooth cleaning elements 214, such bristles can be tapered, end-rounded, spiral, or the like.

In embodiments that use elastomeric materials to form one or more of the tooth cleaning elements 214, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 214 may be coupled to the head body 211 in any manner known in the art, including staples, in-mold tufting (IMT), anchor-free tufting (AFT), or any of the other known modified AFT techniques such as those known as AMR and PTt. In the exemplified embodiment, the bristle tufts 215 are secured to the head body 211 using staples/anchors and the elastomeric cleaning elements 216 are secured to the head body 211 via an injection molding process.

Figure 9:
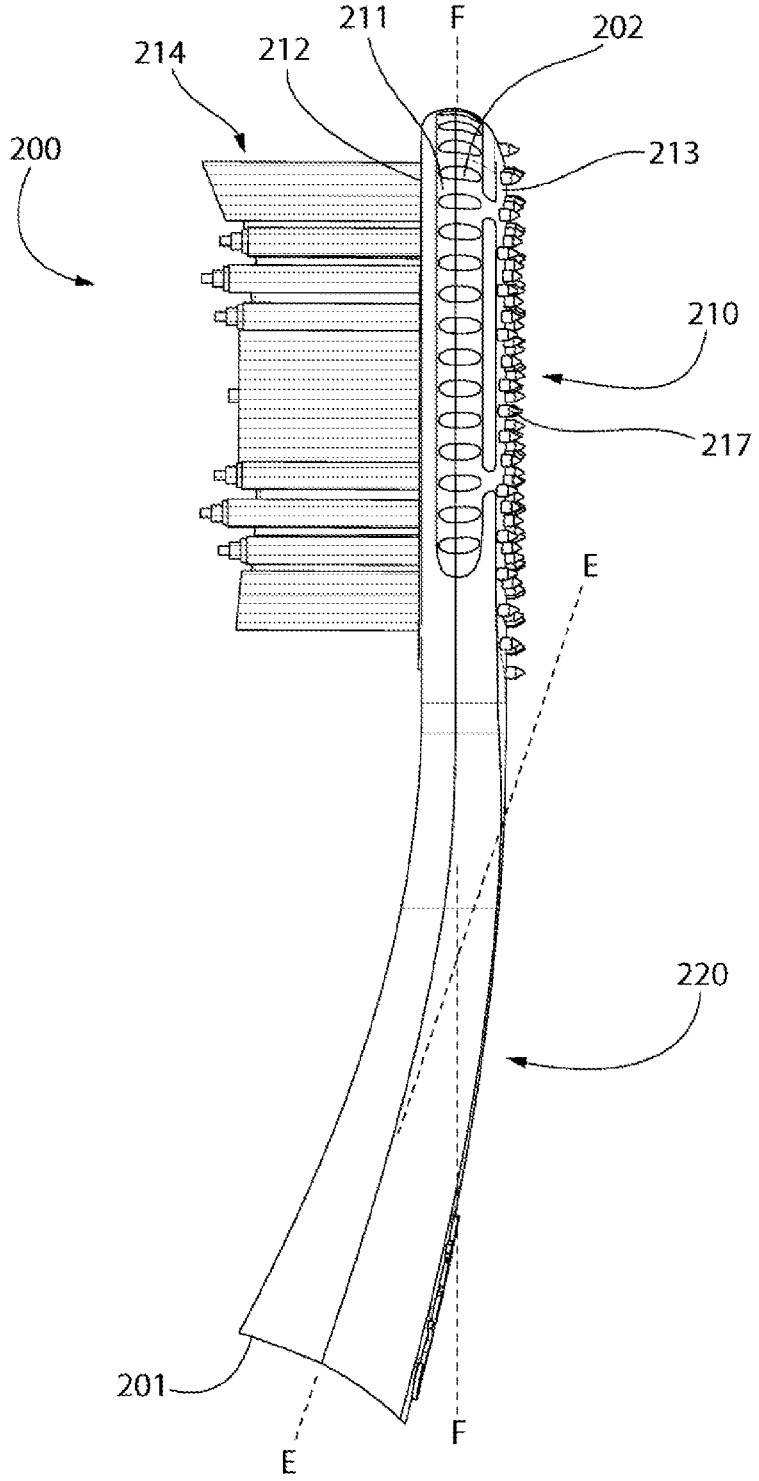
FIG. 9 is a side view of the oral care refill head of FIG. 1.

In the exemplified embodiment, the oral care refill head 200 also comprises a tongue cleaner 217 located on the rear surface 213 of the head body 211. The tongue cleaner 217 may include a pad portion and various protuberances including nubs, ridges, or the like to facilitate a proper cleaning of a tongue of the user (best shown in FIG. 9). The tongue cleaner 217 may be formed from a thermoplastic elastomer, such as the materials noted above for forming the elastomeric cleaning elements 216. In some embodiments, the tongue cleaner 217 and the elastomeric cleaning elements 216 may be integrally formed via an injection molding process such that the head body 211 may include passageways that extend from the front surface 211 to the rear surface 212 so that the raw material can flow to form the elastomeric cleaning elements 216 and the tongue cleaner 217 simultaneously within a mold cavity. Of course, the tongue cleaner 217 could be formed in a separate step from the elastomeric cleaning elements 216 in other embodiments.

The oral care refill head 200 may be formed of a second material that is different than the first material that is used to form the handle 100. For example, the second material may be a hard plastic. Thus, in some embodiments the handle 100 or at least the gripping portion 110 of the handle 100 may be formed from a metal or a metal alloy and the oral care refill head 200 may be formed from a hard plastic. Of course, other material combinations may be used in other embodiments as may be desired. In some embodiments, the material used to form the handle 100 and/or the stem 120 thereof may have a first hardness and the material used to form the oral care refill head 200 or the sleeve portion 220 thereof may have a second hardness, with the first hardness of the first material being greater than the second hardness of the second material. Thus, the handle 100 may be formed of a harder material than the oral care refill head 200. In some embodiments, the stem 120 may be formed of a harder material than the sleeve portion 220 of the oral care refill head 200 irrespective of the materials used to form the other parts of the handle 100 and the oral care refill head 200. In still other embodiments, the oral care refill head 200 and the handle 100 may all be formed from the same material, such as a hard plastic (i.e., polypropylene or polyethylene or combinations thereof).

Figure 3:
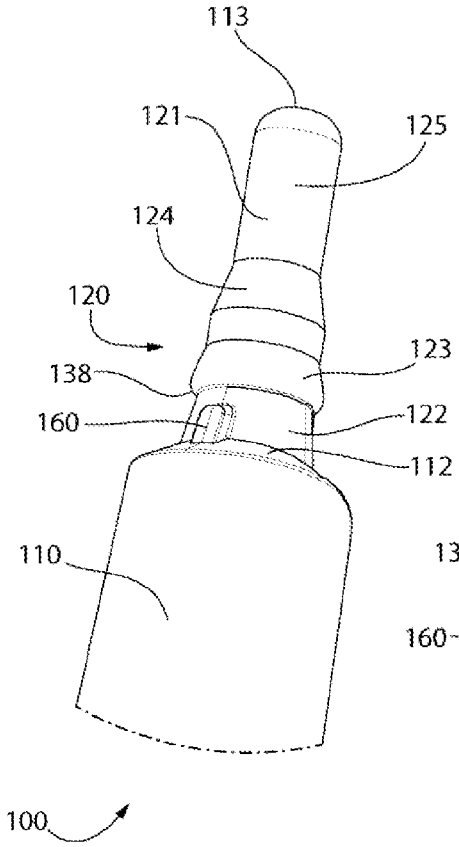
FIG. 3 is a close-up perspective view of area III of FIG. 2.
Figure 4:
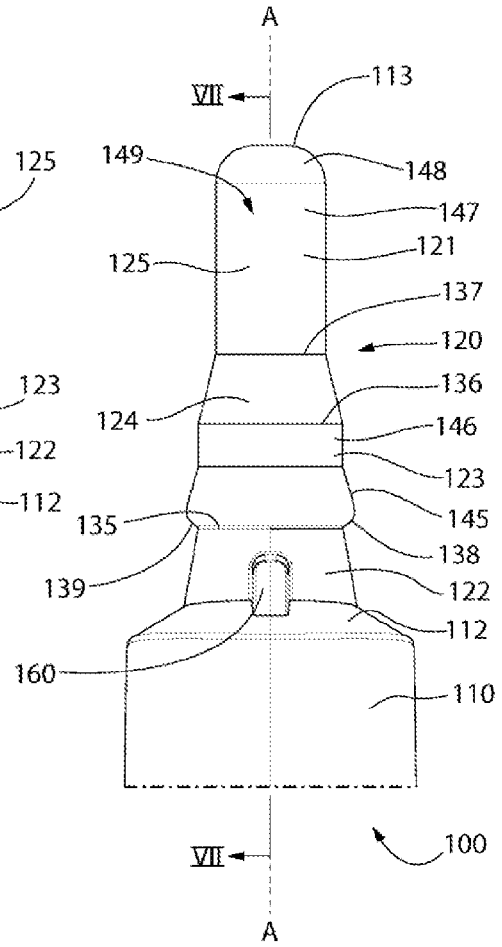
FIG. 4 is a close-up front view of area III of FIG. 2.
Figure 5:
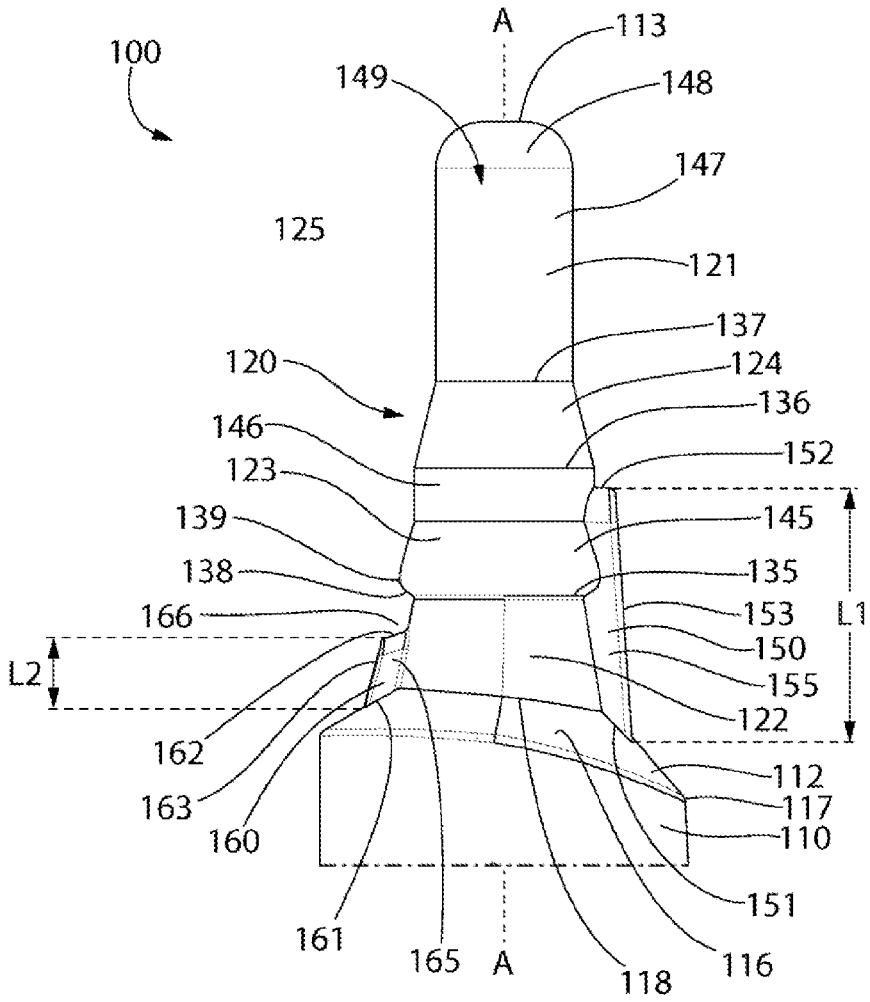
FIG. 5 is a close-up side view of area III of FIG. 2.

Referring to FIGS. 3-5, the stem 120 of the handle 100 will be described in detail in accordance with an exemplary embodiment of the present invention. As noted above, the stem 120 comprises the stem body 121, which in the exemplified embodiment protrudes from the distal end 112 of the gripping portion 110 of the handle 100 and terminates at a distal end 113 of the handle 100 (with the distal end 113 of the handle 100 forming a distal end of the stem 120). While the stem 120 is described herein as extending from the distal end 112 of the gripping portion 110, this does not require the stem 120 to be directly affixed to the distal end 112 of the gripping portion 110. In particular, the stem 120 may be considered to extend from the distal end 112 of the gripping portion 110 even if there is an intermediate structure disposed between the stem 120 and the distal end 112 of the gripping portion 110. Thus, stating that the stem 120 extends from the distal end 112 of the gripping portion 110 includes situations where the stem 120 is coupled directly to and extends directly from the distal end of the gripping portion 110 and situations where the stem extends in an axial direction relative to the gripping portion 110 without being attached directly thereto. The stem 120 (and the stem body 121 thereof) extends along a stem axis A-A from the distal end 112 of the gripping portion 110 of the handle 100 to the distal end 113 of the handle 100. In the exemplified embodiment, the stem body 121 comprises a first axial section 122, a second section 123, a third axial section 124, and a fourth axial section 125. The first, second, third, and fourth axial sections 122, 123, 124, 125 all form a part of the monolithic stem body 121 in the exemplified embodiment.

Thus, the first axial section 122, the second axial section 123, the third axial section 124, and the fourth axial section 125 each form an axial portion of the stem body 121. Specifically, the first section 122 is the section that extends axially (i.e., in the direction of the stem axis A-A) from the distal end 112 of the gripping portion 110 and it terminates in a distal end 135. The second axial section 123 extends axially from the distal end 135 of the first axial section 122 and it terminates in a distal end 136. The third axial section 124 extends axially from the distal end 136 of the second axial section 123 and it terminates in a distal end 137. The fourth axial section 125 extends axially from the distal end 137 of the third axial section 124 and it terminates in the distal end 113 of the stem 120. The distal end 112 of the gripping portion 110 forms an annular shoulder surface that circumscribes the stem 120.

In the exemplified embodiment, the first axial section 122 of the stem 120 (or of the stem body 121) is in the shape of a truncated cone. In particular, the first axial section 122 continuously tapers as it extends further away from the distal end 112 of the gripping portion 110 of the handle 100. Thus, the first axial section 122 continuously tapers from its proximal end (which is the end that is connected directly to the distal end 112 of the gripping portion 110) to its distal end 135. Stated another way, the first axial section 122 has a greater width or diameter at distances that are closer to the distal end 112 of the gripping portion 110 than at distances that are further away from the distal end 12 of the gripping portion 110. The width or diameter of the first axial section 122 decreases as the first axial section 122 extends further from the distal end 112 of the gripping portion 110.

As noted above, the second axial section 123 of the stem 120 extends axially from the first axial section 122 in a direction that is further away from the distal end 112 of the gripping portion 110. Thus, the first axial section 122 is located axially between the second axial section 123 and the distal end 112 of the gripping portion 110 of the handle 100. The second axial section 123 of the stem 120 comprises a lower end surface 138 that protrudes outwardly from the first axial section 122 at the distal end 135 of the first axial section 122. In particular, the lower end surface 138 extends radially outwardly from the outer surface of the first axial section 122 in a direction that is away from the stem axis A-A. Thus, the lower end surface 138 of the second axial section 123 of the stem 120 forms an overhang that juts out radially from the first axial section 122 of the stem 120 at the distal end 135 of the first axial section 122 of the stem 120.

However, the outer surface of the second axial section 123 is a smooth and continuous surface that is free of projections or the like in the exemplified embodiment. Thus, the lower end surface 138 is not the result of a protruding annular rib in the exemplified embodiment, but is instead formed as an integral part of the shape of the second axial section 123. Stated another way, the lower end surface 138 forms a part of the outer surface of the second axial section 123 rather than it protruding outwardly therefrom.

The second axial section 123 of the stem 120 comprises a first portion 139 which comprises the lower end surface 138, a second portion 145 that extends axially from the first portion 139, and a third portion 146 that extends axially from the second portion 145. The first portion 139 of the second axial section 123 of the stem 120 tapers in a direction moving from the second portion 145 of the second axial section 123 towards the first axial section 122 (i.e., the first portion 139 tapers downwardly). As a result of this, and due to the fact that the lower end surface 138 protrudes beyond the outer surface of the first axial section 123 of the stem 120, the lower end surface 138 of the second axial section 123 forms a downwardly facing shoulder that faces downwardly towards the distal end 112 of the gripping portion 110 of the handle 100. The lower end surface or downwardly facing shoulder 138 forms a surface upon which a feature of the oral care refill head 200 may engage to securely coupled the oral care refill head 200 to the handle 100 as described in greater detail herein below. The first portion 139 of the second axial section 123 may be arcuate or rounded as in the exemplified embodiment, which may make it easier to attach and detach the oral care refill head 200 from the handle 100 as described herein. Thus, in the exemplified embodiment the first and second portions 139, 145 of the second axial section 123 form a truncated cone shape whereby a bottom thereof is rounded to form a lip upon which a portion of the oral care refill head 200 may engage.

The second portion 145 of the second axial section 123 of the stem 120 tapers moving in a direction from the first portion 139 of the second axial section 123 towards the distal end 113 of the stem 120. That is, the second portion 145 of the second axial section 123 tapers as it moves further away from the distal end 112 of the gripping portion 110. The second portion 145 continuously tapers in the exemplified embodiment. The transition region between the first and second portions 139, 145 of the second axial section 123 may be rounded as shown in the exemplified embodiment to facilitate the coupling and detachment of the oral care refill head 200 from the handle 100 as described further below. In the exemplified embodiment, the third portion 146 of the second axial section 123 has a constant cross-sectional area and does not taper. That is, the third axial portion 146 is cylindrical in shape rather than being conical as with the second axial portion 145. It may be possible to form the stem 120 such that the third portion 146 of the second axial section 123 is a continuation of the second portion 145 such that it also tapers, in some alternative embodiments.

The third axial section 124 of the stem 120 extends from the distal end 136 of the second axial section 123 of the stem 120. In the exemplified embodiment, the third axial section 124 of the stem 120 is in the shape of a truncated cone in that it continually tapers with increasing distance away from the distal end 112 of the gripping portion 110 and towards the distal end 113 of the stem 120. The invention is not to be so limited in all embodiments and it may be possible for the third axial section 124 to have a cylindrical and non-tapering shape in other embodiments. However, tapering the third axial section 124 may assist in forming a guide to guide the oral care refill head 200 onto the stem 120 of the handle 100 during coupling of the oral care refill head 200 to the handle 100 as described herein.

The fourth axial section 125 of the stem 120 extends from the distal end 137 of the third axial section 124 of the stem 120. The fourth axial section 125 is cylindrical and has a constant cross-sectional area along a first portion 147 thereof, and then is rounded along a distal portion 148 thereof. Of course, the fourth axial section 125 could be cylindrical with a constant cross-sectional area along its entire axial length in other embodiments, and may exclude the rounded distal portion 148.

Figure 6:
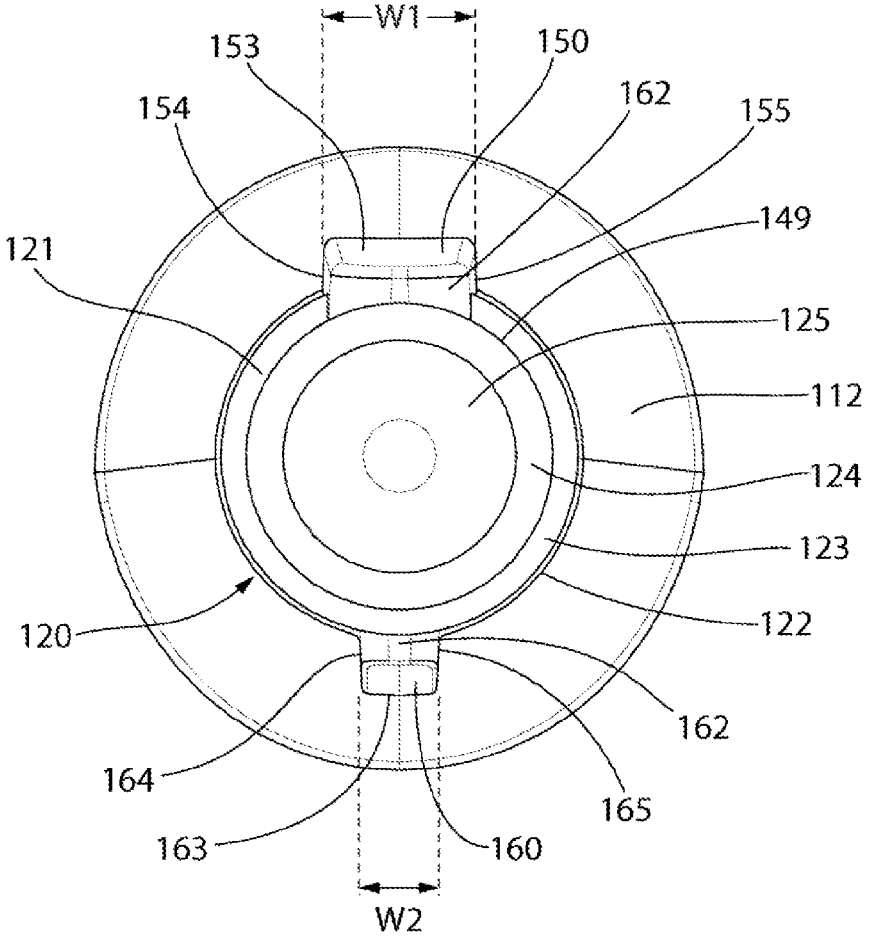
FIG. 6 is a top view of the handle of the oral care implement of FIG. 1.
Figure 7:
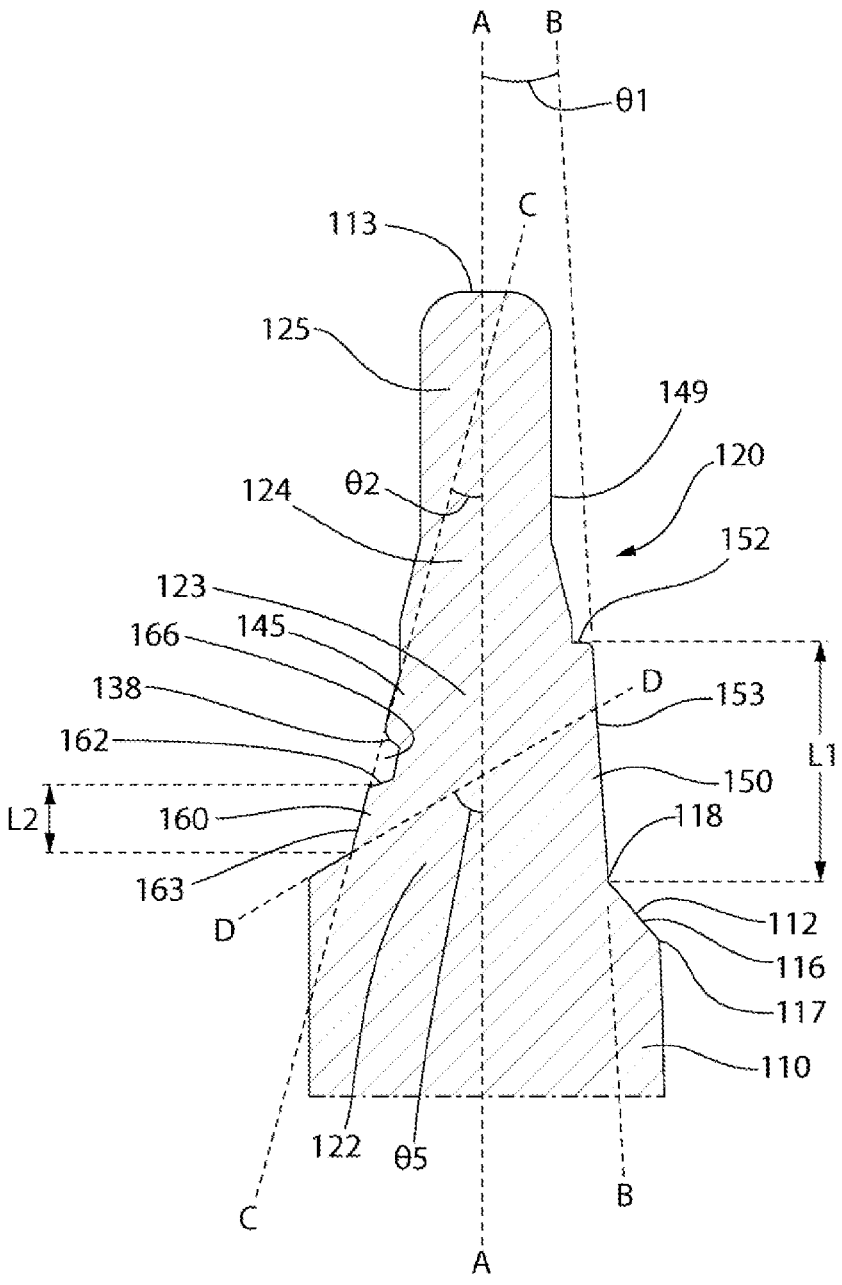
FIG. 7 is a cross-sectional view taken along line VII-VII of FIG. 4.

Referring to FIGS. 5-7, the stem 120 and its features and structures will be further described. The stem body 121 has an outer surface 149 that extends along each of the first, second, third, and fourth axial sections 122, 123, 124, 125 of the stem 120. Furthermore, the stem 120 comprises a first alignment element 160 and a second alignment element 150, each of which protrudes from the outer surface 149 of the stem body 121 and extends axially along the stem body 121. In the exemplified embodiment, each of the first and second alignment elements 150, 160 on the stem 120 are ribs that protrude from the outer surface 149 of the stem body 121. Furthermore, each of the first and second alignment elements 150 is elongated in a direction of the stem axis A-A. The second alignment element 150 is located on a first side of the stem axis A-A and the first alignment element 160 is located on a second side of the stem axis A-A. Thus, the stem axis A-A lies in a plane, and the first and second alignment elements 150, 160 are located on opposite sides of the plane. In the exemplified embodiment, the first and second alignment elements 150, 160 are located 180° apart, although they could be spaced apart at other circumferential distances in other embodiments. The first and second alignment elements 150, 160 are configured to interact with alignment elements of the oral care refill head 200 to ensure that the oral care refill head 200 is in a proper orientation relative to the handle 100 when the oral care refill head 200 is attached to the handle 100. That is, the oral care refill head 200 may only be attached to the handle 100 in one specific angular position relative to the handle 100 in some embodiments.

The first alignment element 160 extends from a first end 161 to a second end 162 (the second end 162 may also be referred to herein as the distal end of the first alignment element 160) in the direction of the stem axis A-A. The first end 162 is located at the distal end 112 of the gripping portion 110. That is, the first alignment element 160 extends directly from and is in fact attached to the distal end 112 of the gripping portion 110. It may be possible for the first end 161 of the first alignment element 160 to be spaced from the distal end 112 of the gripping portion 110 in alternative embodiments. In the exemplified embodiment, the second end 162 of the first alignment element 160 is oriented at an oblique angle relative to the stem axis A-A. That is, the second end 162 of the first alignment element 160 is angled upwardly as it extends from an outer surface of the first alignment element 160 towards the outer surface 149 of the stem body 121. Thus, the second end 162 of the first alignment element 160 extends along an axis D-D that intersects the stem axis A-A at an oblique angle Θ5.

The first alignment element 160 comprises an outer surface 163 that is spaced a distance from the outer surface 149 of the stem body 121 of the stem 120, a first side surface 164 extending from the outer surface 149 of the stem 120 to the outer surface 163, and a second side surface 165 extending from the outer surface 149 of the stem 120 to the outer surface 163. The first alignment element 160 has a length L2 measured from the first end 161 to the second end 162 (i.e., measured from the distal end 112 of the gripping portion 110 to the second end 162). The first alignment element 160 has a width W2 measured from the first side surface 164 to the second side surface 165. The length L2 is greater than the width W2 as the first alignment element 160 is elongated in the axial direction. In the exemplified embodiment, the length L1 of the second alignment element 150 is greater than the length L2 of the first alignment element 160.

The first alignment element 160 extends only along the first axial section 122 of the stem 120. Thus, the first alignment element 160 does not extend along any of the second, third, or fourth axial sections 123, 124, 125 of the stem 120. Moreover, in the exemplified embodiment the second end 162 of the first alignment element 160 is positioned below the distal end 135 of the first axial section 122 such that the first axial section 122 has a greater length than the first alignment element 160 and the first alignment element 160 only extends along a portion of the first axial section 122. Thus, the second end 162 of the first alignment element 160 is spaced apart from the lower end surface 138 of the second axial section 123 by a gap 166. This ensures that there is space for a locking feature of the oral care refill head 200 to nest while engaging the lower end surface 138 of the second axial section 123 to couple the oral care refill head 200 onto the handle 100.

The outer surface 163 of the first alignment element 160 is oriented at an oblique angle relative to the stem axis A-A. That is, the outer surface 163 of the first alignment element 160 is neither parallel to nor perpendicular to the stem axis A-A. The outer surface 163 of the first alignment element 160 extends along a first alignment axis C-C that intersects the stem axis A-A at a second angle Θ2. In the exemplified embodiment, the first alignment axis C-C intersects the stem 120. Moreover, in the exemplified embodiment the first alignment axis C-C passes through (i.e., intersects) the distal end 113 of the stem 120. Thus, the first alignment axis C-C intersects the stem axis A-A at a location that is located along the length of the stem 120. In the exemplified embodiment, the first alignment axis C-C intersects the stem axis A-A along the fourth axial portion 125 of the stem 120. In the exemplified embodiment, the outer surface 149 of the stem 120 along the second portion 145 of the second axial section 123 of the stem 120 lies on the first alignment axis C-C.

The second alignment element 150 extends from a first end 151 to a second end 152 (the second end 152 may also be referred to herein as the distal end of the second alignment element 150) in the direction of the stem axis A-A. The first end 151 is located at the distal end 112 of the gripping portion 110. That is, the second alignment element 150 extends directly from and is in fact attached to the distal end 112 of the gripping portion 110. It may be possible for the first end 151 of the second alignment element 150 to be spaced from the distal end 112 of the gripping portion 110 in alternative embodiments. In the exemplified embodiment, the second end 152 of the second alignment element 150 is oriented perpendicularly relative to the stem axis A-A.

The second alignment element 150 comprises an outer surface 153 that is spaced apart from the outer surface 149 of the stem body 121 by a distance, a first side surface 154 extending from the outer surface 149 of the stem 120 to the outer surface 153, and a second side surface 155 extending from the outer surface 149 of the stem 120 to the outer surface 153. The second alignment element 150 has a length L1 measured from the first end 151 to the second end 152 (i.e., measured from the distal end 112 of the gripping portion 110 to the second end 152). The second alignment element 150 has a width W1 measured from the first side surface 154 to the second side surface 155. The length L1 is greater than the width W1 as the second alignment element 150 is elongated in the axial direction. Moreover, in the exemplified embodiment the width W2 of the second alignment element 150 is greater than the width W2 of the first alignment element 160. By having both the length and width of the second alignment element 150 be greater than the length and width of the first alignment element 160, it can be ensured that the second alignment element 150 cannot nest within a groove of the oral care refill head 200 which is intended for the first alignment element 160. Thus, this feature of the relative sizing of the first and second alignment elements 150, 160 helps to ensure that the oral care refill head 200 is properly oriented relative to the handle 100.

The second alignment element 150 extends along the first axial section 122 of the stem 120 and along the second axial section 123 of the stem 120. In fact, in the exemplified embodiment the second alignment element 150 extends along the first axial section 122 and each of the first, second, and third portions 139, 145, 146 of the second axial portion 123 of the stem 120. However, in the exemplified embodiment the second end 152 of the second alignment element 150 is located below the distal end 136 of the second axial section 123, and thus the second alignment element 150 does not extend along an entirety of the second axial section 123. However, the invention is not to be so limited in all embodiments and the specific length L1 of the first alignment portion 150 and the relative location of the second end 152 of the second alignment element 150 along the stem 120 may be modified from the embodiment shown in the drawings without affecting functionality. The length of the second alignment element 150 should be consistent with, the same as or smaller than, the length of a groove in the oral care refill head 200 within which the second alignment element 150 nests when the oral care refill head 200 is coupled to the handle 100, as will be discussed in greater detail below.

The outer surface 153 of the second alignment element 150 is oriented at an oblique angle relative to the stem axis A-A. That is, the outer surface 153 of the second alignment element 150 is neither parallel to nor perpendicular to the stem axis A-A. The outer surface 153 of the second alignment element 150 extends along a second alignment axis B-B that intersects the stem axis A-A at a first angle Θ1. In the exemplified embodiment, the second angle Θ2 at which the first alignment axis C-C intersects the stem axis A-A is a greater angle than the first angle Θ1 at which the second alignment axis B-B intersects the stem axis A-A. Thus, the outer surface 163 of the first alignment element 160 is oriented at a greater angle relative to the stem axis A-A than the outer surface 153 of the second alignment element 150. In the exemplified embodiment, the second alignment axis B-B does not intersect the stem 120. Thus, the second alignment axis B-B intersects the stem axis A-A at a location that is remote from the stem 120. In the figures provided, the intersection between the second alignment axis B-B and the stem axis A-A is not shown, but it should be appreciated that it is at some distance above the distal end 113 of the stem 120 moving in a direction away from the handle 100.

Referring to FIGS. 5 and 7, the distal end 112 of the gripping portion 110 of the handle 100 will be further described. As mentioned above, the distal end 112 of the gripping portion 110 of the handle 100 comprises an annular shoulder surface 116 that circumscribes the stem 120. The annular shoulder surface 116 extends radially from an outer shoulder edge 117 to an inner shoulder edge 118, with the outer shoulder edge 117 being aligned with the outer surface of the gripping portion 110 of the handle 100 and the inner shoulder edge 118 being adjacent to the stem 120. In the exemplified embodiment, the annular shoulder surface 116 is inclined downwardly away from the distal end 113 of the stem 120 moving from the inner shoulder edge 118 to the outer shoulder edge 117 with increasing distance from the stem axis A-A. In an alternative embodiment, the annular shoulder surface 116 may be inclined upwardly towards the distal end 113 of the stem 120 moving from the inner shoulder edge 118 to the outer shoulder edge 117. In either case, the annular shoulder surface 116 is angled in only one direction such that it forms a conical shaped surface (particularly, a truncated cone).

Referring to FIGS. 8-11, the oral care refill head 200 will be further described. As mentioned previously, the oral care refill head 200 comprises the oral care treatment portion 210 and the sleeve portion 220. Specifically, the oral care treatment portion 210 comprises the head body 211 having a front surface 212 from which the tooth cleaning elements 214 extend and an opposite rear surface 213. The tongue cleaner 217 is positioned on the rear surface 213, although the tongue cleaner 217 could be omitted in alternative embodiments. In the exemplified embodiment, the tongue cleaner 217 comprises a plurality of nubs that protrude from the rear surface 213 of the head body 211 and can be useful for cleaning of the user's tongue and other soft tissue surfaces. The oral care refill head 200 extends from the proximal end 201 that is formed by the proximal edge surface 222 of the sleeve portion 220 to the distal end 202 that is formed by the terminal end of the oral care treatment portion 210.

In this embodiment, the proximal edge surface 222 of the sleeve portion 220 defines an opening 230 into the sleeve cavity 221. Thus, the sleeve cavity 221 is open at the proximal edge surface 222 of the sleeve portion 220. The sleeve cavity 221 extends along a cavity axis E-E from the opening 230 at the proximal edge 222 to a terminal end wall 231. The proximal edge surface 222 of the sleeve portion 220 extends radially from an outer sleeve edge 223 to an inner sleeve edge 224. The proximal edge surface 222 is inclined in one direction downwardly away from the oral treatment portion 210 from the inner sleeve edge 223 to the outer sleeve edge 223 with increasing distance from the cavity axis E-E. However, the proximal edge surface 222 could be inclined upwardly towards the oral treatment portion 210 in other embodiments, so long as the proximal edge surface 222 of the sleeve portion 220 of the oral care refill head 200 is configured to mate with the distal end 112 of the gripping portion 110 of the handle 100. This allows the proximal edge surface 222 of the sleeve portion 220 to abut the annular shoulder surface 116 of the handle 100 when the oral care refill head 200 is coupled to the handle 100.

The head body 211 of the oral care refill head 200 extends along a head longitudinal axis F-F that is inclined relative to the cavity axis E-E. Thus, in the exemplified embodiment the head longitudinal axis F-F is inclined forward moving from a proximal end of the head body 211 that is adjacent to the sleeve portion 220 to a distal end of the head body 211 (which is also the distal end 202 of the oral care refill head 200).

The sleeve cavity 221 is defined by an inner surface 227 of the sleeve portion 220. The oral care refill head 200 comprises a sleeve snap element 240, a first alignment groove 260, and a second alignment groove 250 that interact with previously described features of the stem 120 to properly orient the oral care refill head 200 relative to the handle 100 and secure the oral care refill head 200 to the handle 100. The first and second alignment grooves 250, 260 are located on opposite sides of the cavity axis E-E in the exemplified embodiment. In fact, in the exemplified embodiment the first and second alignment grooves 250, 260 are positioned 180° apart, although other spacing distances may be possible in other embodiments. In some embodiments, the circumferential spacing between the first and second alignment grooves 250, 260 is consistent with the spacing distance between the first and second alignment elements 150, 160 of the stem 120). However, this is not required in all embodiments. In particular, the first and/or second alignment grooves may extend a greater circumferential distance around the sleeve cavity 221 than shown in the drawings. That is, the exact size or width of the first and second alignment grooves 250, 260 is not necessarily limiting of the present invention so long as some sort of groove exists in the sleeve cavity 221 which is configured to receive the first and second alignment elements 150, 160 of the stem 120 described above.

The sleeve snap element 240, the second alignment groove 250, and the first alignment groove 260 are located within the sleeve cavity 221 of the sleeve portion 220 of the oral care refill head 200. In the exemplified embodiment, the sleeve snap element 240 is an annular protrusion that protrudes from the inner surface 227 of the sleeve portion 220. The sleeve snap element 240 extends circumferentially around an entirety of the inner surface 227 of the sleeve portion 220 except for where the second alignment groove 250 is located. Thus, the sleeve snap element 240 extends circumferentially from a first end 241 to a second end 242, with the second alignment groove 250 being located between the first and second ends 241, 242. The sleeve snap element 240 is configured to snap interlock with the lower end surface 138 of the stem 120 as has been described above when the oral care refill head 200 is coupled to the handle 100.

The first alignment groove 260 is a groove that is formed into the inner surface 227 of the sleeve portion 220 and is elongated in a direction of the cavity axis E-E. In the exemplified embodiment, the first alignment groove 260 is located on an opposite side of the cavity axis E-E than the second alignment groove 250. However, this is not required in all embodiments so long as the first and second alignment grooves 250, 260 are designed, positioned, and configured to receive the first and second alignment elements 150, 160 of the stem 120. The first alignment groove 260 extends from a first open groove end 261 to a first closed groove end wall 262 in a direction of the cavity axis E-E. The first open groove end 261 is located at the proximal end 222 of the sleeve portion 220 and the first closed groove end wall 262 is located within the sleeve cavity 221. In the exemplified embodiment, the first closed groove end wall 262 is oriented oblique to the cavity axis E-E to match the orientation of the second end 252 of the first alignment element 160 of the stem 120. In particular, the first closed groove end wall 262 extends along an axis I-I that intersects the cavity axis E-E at an oblique angle Θ6. The oblique angle Θ6 may be between 70° and 89° in some embodiments.

The first alignment groove 260 has a length L4 measured from the first open groove end 261 to the first closed groove end wall 262 and a width W4 measured in a direction transverse to the length L4. The length L4 and width W4 of the first alignment groove 260 matches or corresponds with the length L2 and the width W2 of the first alignment element 160 of the stem 120 so that the first alignment element 160 of the stem 120 can comfortably nest within the first alignment groove 260 of the oral care refill head 200. Of course, the length L4 and width W4 of the first alignment groove 260 may be larger, and even significantly larger, than the length L2 and the width W2 of the first alignment element 160 in other embodiments so long as it is designed, positioned, and configured to receive the first alignment element 160 therein.

Figure 11:
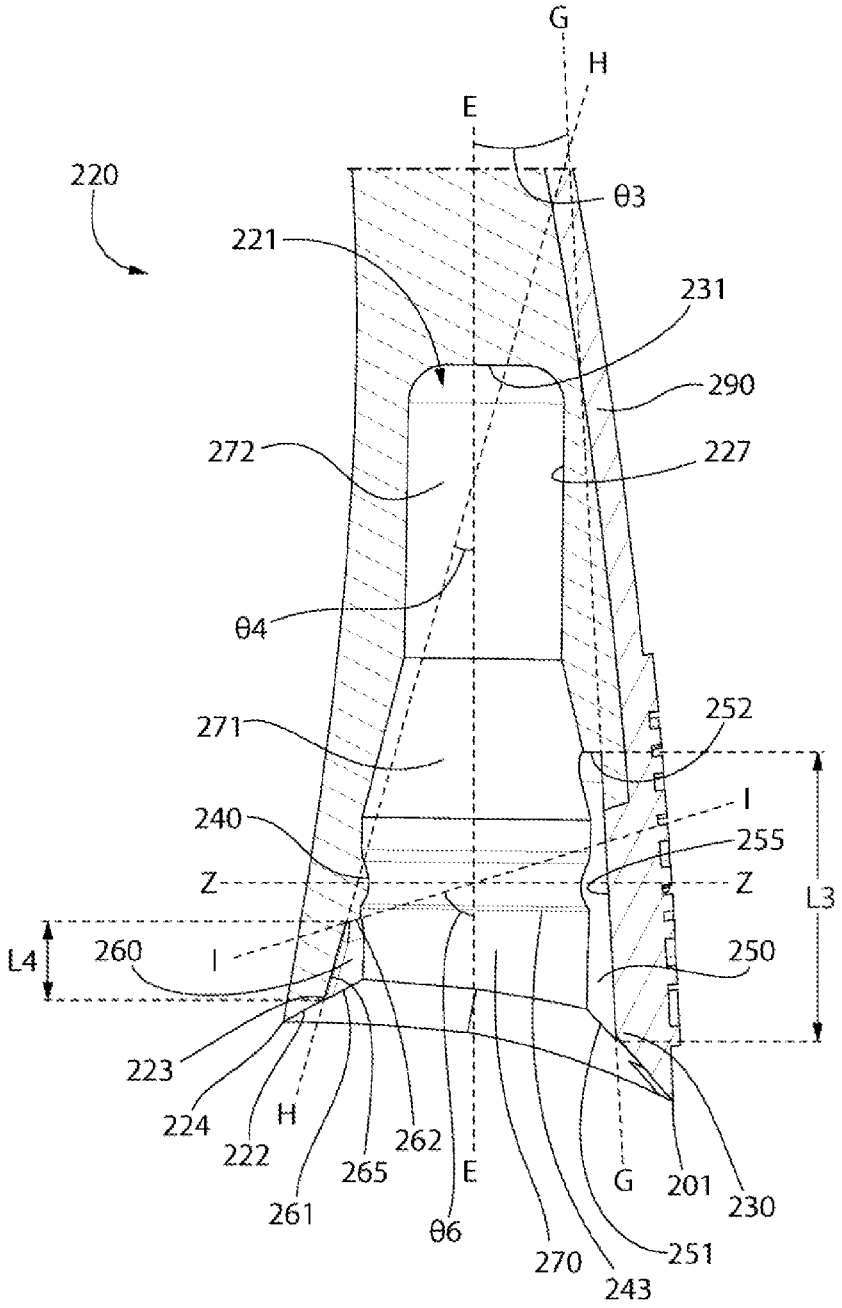
FIG. 11 is a cross-sectional view taken along line XI-XI of FIG. 8.

The first alignment groove 260 comprises a floor portion 265 that is recessed relative to the inner surface 227 of the sleeve portion 220. In the exemplified embodiment, the floor portion 265 extends along a first alignment groove axis H-H that is oriented oblique relative to the cavity axis E-E. The first alignment groove axis H-H intersects the cavity axis E-E at a fourth angle Θ4. Moreover, in the exemplified embodiment the second alignment groove axis H-H passes through the sleeve cavity 221 and intersects the cavity axis E-E at a location that is positioned within the sleeve cavity 221. The second alignment groove axis H-H also passes through or intersects the terminal end wall 231 of the sleeve cavity 221. The first closed groove end wall 262 of the first alignment groove 260 is oriented at an obtuse angle relative to the floor 265 of the first alignment groove 260, as best seen in FIG. 11.

In the exemplified embodiment, an entirety of the first alignment groove 260 is located axially between the sleeve snap element 240 and the proximal end 201 of the oral care refill head 200. Thus, there is a space or gap between a bottom-most edge 243 of the sleeve snap element 241 and the second closed groove end wall 262. Stated another way, the reference plane Z-Z does not intersect the first alignment groove 260. Instead, the first alignment groove 260 is located entirely between the reference plane Z-Z and the proximal end 201 of the oral care refill head 200. However, in other embodiments the first alignment groove 260 may have a greater length and may extend axially beyond the sleeve snap element 240.

The second alignment groove 250 is a groove that is formed into the inner surface 227 of the sleeve portion 220 and is elongated in a direction of the cavity axis E-E. The second alignment groove 250 is located on a part of the sleeve portion 220 that is aligned with the rear surface 213 of the head portion 211. The second alignment groove 250 extends from a second open groove end 251 to a second closed groove end wall 252 in a direction of the cavity axis E-E. The second open groove end 251 is located at the proximal end 222 of the sleeve portion 220 and the second closed groove end wall 252 is located within the sleeve cavity 221 at a location that is between the proximal end 222 and the closed groove end wall 231. In the exemplified embodiment, the second closed groove end wall 252 is oriented perpendicular to the cavity axis E-E to match the orientation of the second end 152 of the second alignment element 150 of the stem 120. The second alignment groove 250 has a length L3 measured from the second open groove end 251 to the second closed groove end wall 252 and a width W3 measured in a direction transverse to the length L3. In the exemplified embodiment, the length L3 and width W3 of the second alignment groove 250 matches or corresponds (or is slightly greater than) with the length L1 and the width W1 of the second alignment element 150 of the stem 120 so that the second alignment element 150 of the stem 120 can comfortably, yet snugly nest within the second alignment groove 250 of the oral care refill head 200. However, as mentioned above, the length L3 and width W3 of the second alignment groove 250 may be significantly greater than the length L1 and width W1 of the second alignment element 150 of the stem 120 in alternative embodiments so long as it is sized and configured to receive the second alignment element 150 therein. In the exemplified embodiment, the length L3 and width W3 of the second alignment groove 250 is greater than the length L4 and the width W4, respectively, of the first alignment groove 260.

The second alignment groove 250 comprises a floor portion 255 that is recessed relative to the inner surface 227 of the sleeve portion 220. In the exemplified embodiment, the floor portion 255 extends along a second alignment groove axis G-G that is oriented oblique relative to the cavity axis E-E. The second alignment groove axis G-G intersects the cavity axis E-E at a third angle Θ3. In the exemplified embodiment, the second alignment groove axis G-G does not intersect or otherwise pass through the sleeve cavity 221. The second alignment groove axis G-G intersects the cavity axis E-E at a location that is outside of the sleeve cavity 221. In the exemplified embodiment, the fourth angle Θ4 at which the first alignment groove axis H-H intersects the cavity axis E-E is greater than the third angle Θ3 at which the first alignment groove axis G-G intersects the cavity axis E-E. In the exemplified embodiment, the oblique angle Θ6 at which the axis I-I intersects the cavity axis E-E is greater than each of the third and fourth angles Θ3, Θ4.

Figure 8:
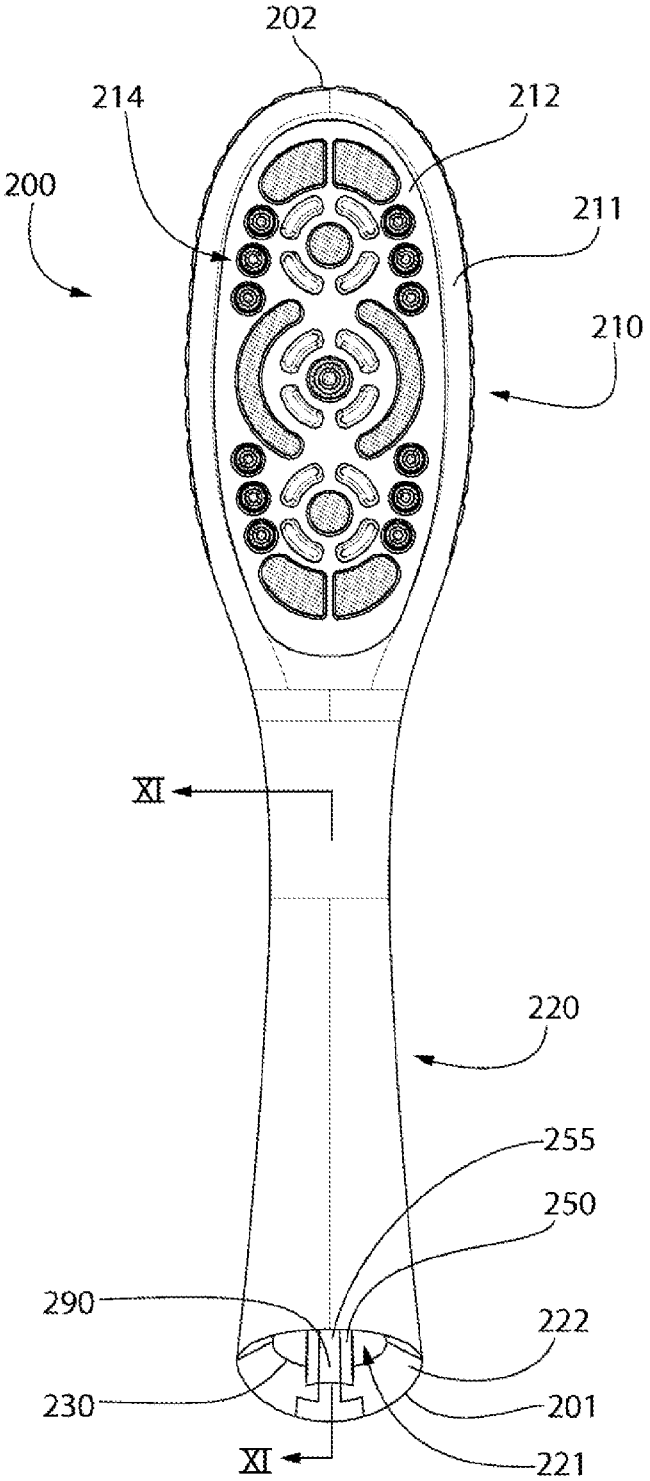
FIG. 8 is a front view of the oral care refill head of FIG. 1.
Figure 10:
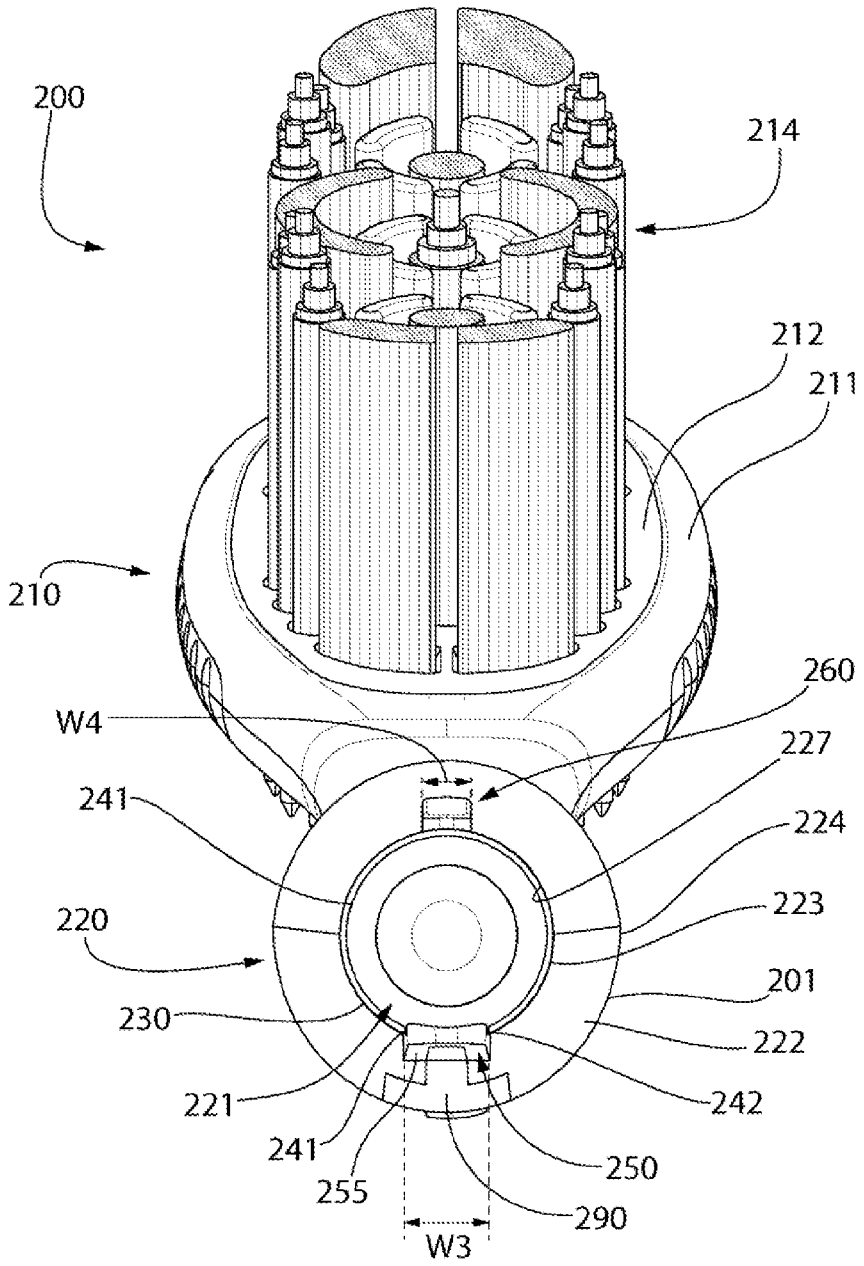
FIG. 10 is a bottom view of the oral care refill head of FIG. 1.

In the exemplified embodiment, a strip of elastomeric material 290 that is integral with the tongue cleaner 217 extends from the tongue cleaner 217 downwardly to the proximal end 201 of the oral care refill head 200 along the rear surface thereof. Furthermore, the strip of elastomeric material 290 extends through an entirety of the thickness of the oral care refill head 200 at a position that is aligned with at least a portion of the second alignment groove 250. Thus, as shown in FIGS. 8, 10, and 11, the strip of elastomeric material 290 forms a portion of the floor 255 of the second alignment groove 250. That can be beneficial in that it may provide the oral care refill head 200 with some additional degree of flexibility to enable the oral care refill head 200 to flex outwardly as it is being attached to the handle 100 to allow the sleeve snap element 240 to snap interlock with the downwardly facing shoulder of the stem 120, as described in greater detail below with reference to FIGS. 12A-14B. In the exemplified embodiment, a reference plane Z-Z that is transverse to the cavity axis E-E intersects both the second alignment groove 250 and the sleeve snap element 240.

Figure 14A:
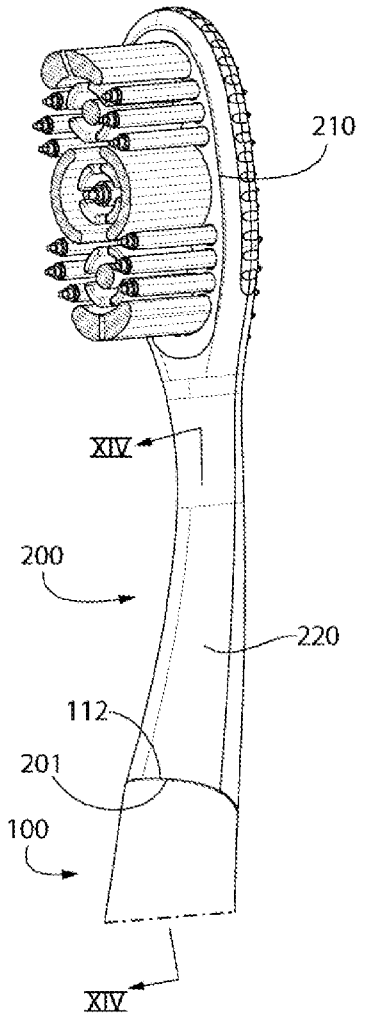
FIG. 14A is a perspective view illustrating the oral care refill head of FIG. 1 and a portion of the handle of FIG. 1 in the attached state.
Figure 14B:
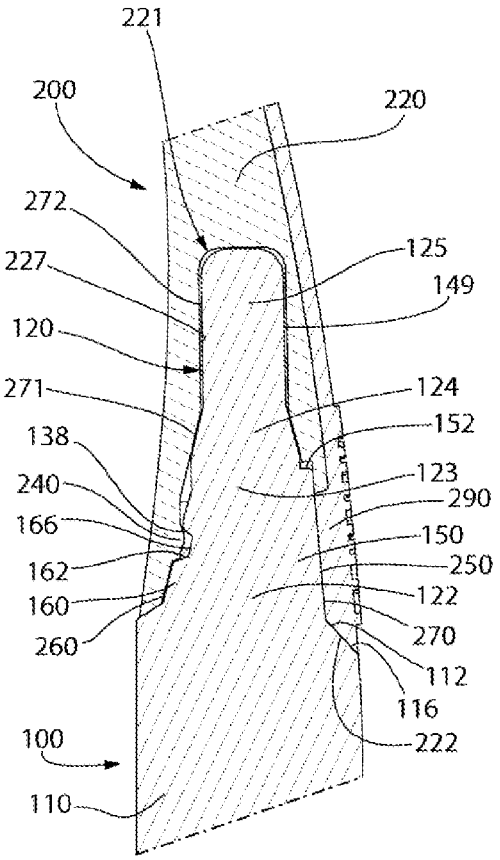
FIG. 14B is a cross-sectional view taken along line XIV-XIV of FIG. 14A.

The sleeve cavity 221 has a shape that generally, although not exactly, matches up with or corresponds to the shape of the stem 120 of the handle 100. In particular, the sleeve cavity 221 comprises a first axial section 270 that is adjacent to the proximal end 201, a second axial section 271 that extends axially from the first axial section, and a third axial section 272 that extends axially from the second axial section 271 to the terminal end wall 231. As described below, the first axial section 122 of the stem 120 nests within the first axial section 270 of the sleeve cavity 221, the second and third axial sections 123, 124 of the stem 120 nest within the second axial section 271 of the sleeve cavity 221, and the fourth axial section 125 of the stem 120 nests within the third axial section 272 of the sleeve cavity 221. This is shown in FIGS. 14A-14B, discussed below.

Figure 12A:
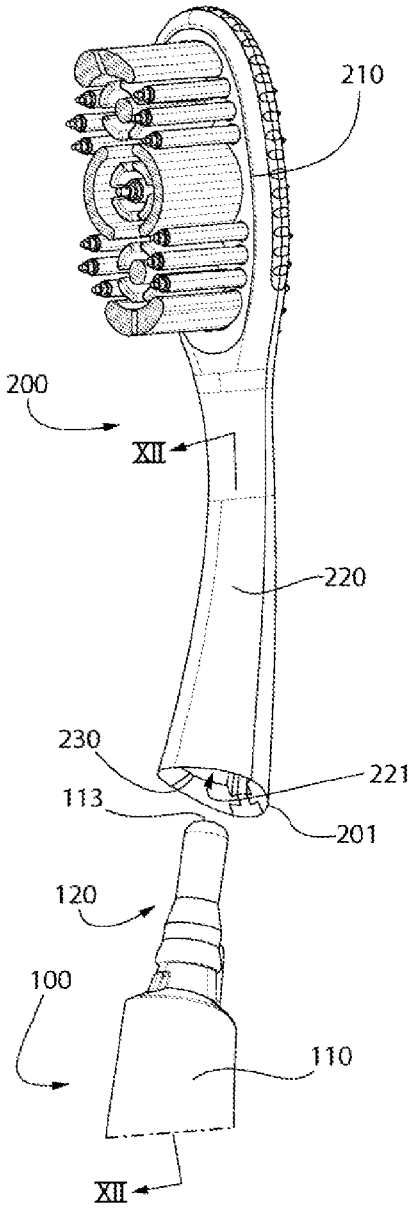
FIG. 12A is a perspective view illustrating the oral care refill head of FIG. 1 positioned in alignment with a stem portion of the handle of FIG. 1 for attachment thereto.
Figure 12B:
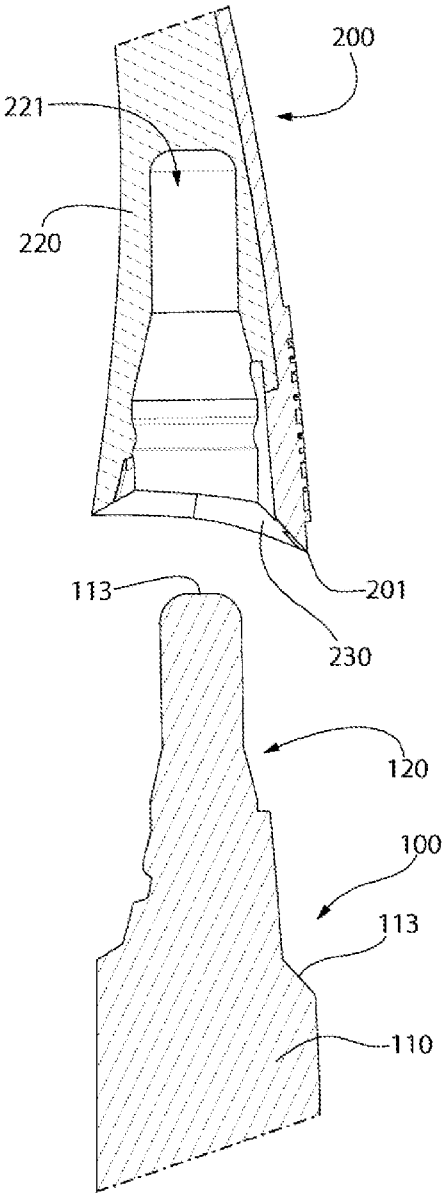
FIG. 12B is a cross-sectional view taken along line XII-XII of FIG. 12A.

Referring now to FIGS. 12A-14B, the process of coupling the oral care refill head 200 to the handle 100 in partial perspective views along with a matching cross-sectional view is illustrated and will be described. As shown in FIGS. 12A and 12B, the first step is to align the opening 230 of the sleeve cavity 221 with the stem 120 of the handle 100, and particularly with the distal end 113 of the handle 100. In particular, the distal end 113 of the handle 100 is aligned with the proximal end 201 of the oral care refill head 200.

Figure 13A:
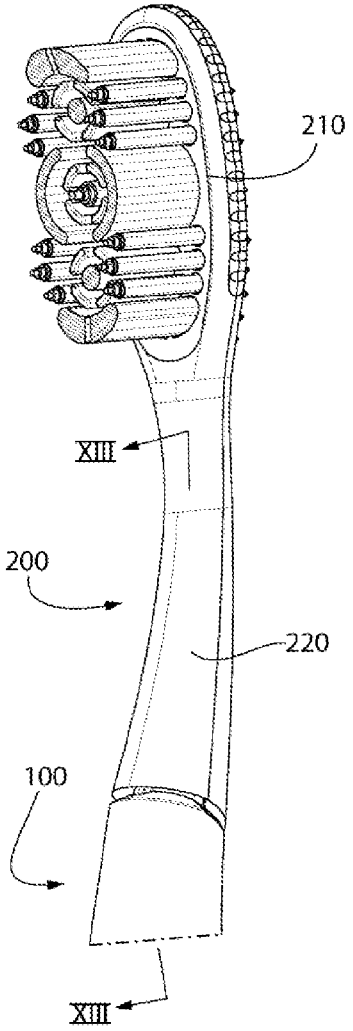
FIG. 13A is a perspective view illustrating the stem portion of the handle of FIG. 1 partially inserted into a cavity of the oral care refill head of FIG. 1.
Figure 13B:
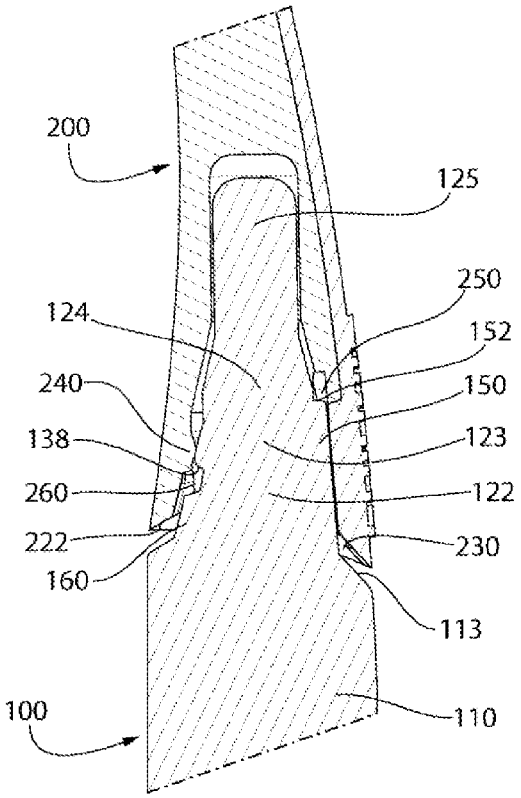
FIG. 13B is a cross-sectional view taken along line XIII-XIII of FIG. 13A.

Next, referring to FIGS. 13A and 13B, the oral care refill head 200 is lowered so that the stem 120 of the handle 100 enters the sleeve cavity 221 of the sleeve portion 220 of the oral care refill head 200. The first and second alignment elements 150, 160 of the stem 120 must be rotationally/circumferentially aligned with the first and second alignment grooves 250, 260 of the oral care refill head 200, respectively, in order for the stem 120 to be inserted into the sleeve cavity 221 as deeply as shown in FIGS. 13A and 13B. Specifically, the third and fourth axial sections 124, 125 of the stem 120 can pass through the opening 230 in the proximal end 222 of the sleeve portion 220 without regard to the relative rotational orientations of the oral care refill head 200 and the handle 100. However, if the oral care refill head 200 and the handle 100 are not properly oriented relative to one another, the second end 152 of the second alignment element 150 of the stem 120 will bump against the proximal edge surface 222 of the sleeve portion 220 of the oral care refill head 200 and prevent further insertion of the stem 120 into the sleeve cavity 221. If such bumping occurs, this should prompt the user to rotate the oral care refill head 200 relative to the handle 100 until the second alignment element 150 of the stem 120 is aligned with the second alignment groove 250 of the oral care refill head 200. When this is achieved, the stem 120 will be able to be further inserted into the sleeve cavity 221 such that the second alignment element 150 of the stem 120 mates with and nests within the second alignment groove 250 of the oral care refill head 200 and the first alignment element 160 of the stem 120 mates with and nests within the first alignment groove 260 of the oral care refill head 200, as shown in FIG. 13B.

In FIGS. 13A and 13B, the stem 120 of the handle 100 is partially nested within the sleeve cavity 221 of the oral care refill head 200 to the point that the sleeve snap element 140 is abutting against the protruding portion of the second axial section 123 of the stem 120 which is just above the lower end surface 138 thereof. Due to the outwardly protruding shape of the second axial section 123 when moving in a direction from the third axial section 124 towards the first axial section 122 and the protruding nature of the sleeve snap element 240, an additional force is required by the user to force the sleeve snap element 240 to move axially past second axial section 123 of the stem 120.

Referring to FIGS. 14A and 14B, the oral care refill head 200 is illustrated in the second state in which it is fully coupled to the handle 100. As can be seen, the sleeve snap element 240 has passed over the bulge formed by the lower end surface 138 of the second axial section 123 of the stem 120. In the exemplified embodiment, this creates a snap-fit interlock between the sleeve snap element 240 and the downwardly facing shoulder of the lower end surface 138 of the second axial section 123 of the stem 120. Thus, in some embodiments the downwardly facing shoulder of the lower end surface 138 of the second axial section 123 of the stem 120 may be a stem snap element of the stem 120. The snap-fit interlock may be achieved by the sleeve portion 220 of the oral care refill head 200 flexing slightly outward as the sleeve snap element 240 passes over the second axial portion 123 of the stem 120. As noted above, this may be facilitated or assisted by the elastomeric strip 290 that extends through the full thickness of the sleeve portion 220 of the oral care refill head 200 along the second alignment groove 250. Once the snap-fit interlock between the sleeve snap element 240 and the lower end surface 138 of the second axial section 123 of the stem is achieved, the oral care refill head 200 is securely coupled to the handle 100 such that a force that overcomes the snap-fit interlock is required to be applied to the oral care refill head 200 and/or the handle 100 in opposite directions in order to detach the oral care refill head 200 from the handle 100. As seen in FIG. 14B, when the oral care refill head 200 is in the second state and attached to the handle 100, the sleeve snap element 240 nests within the gap 166 between the second end 162 of the first alignment element 160 and the lower end surface 138 of the second axial section 123 of the stem 120.

Although a snap-fit interlock between the sleeve snap element 240 and the downwardly facing shoulder of the lower end 138 of the second axial section 123 of the stem 120 is described as the attachment feature in the exemplified embodiment, the invention is not to be so limited in all embodiments. In other embodiments, there may be a friction fit, a press fit, or the like which achieves the coupling of the oral care refill head 200 to the handle 100. When the snap-fit interlock is used, an audible clicking sound may be heard when the sleeve snap element 240 snaps over the downwardly facing shoulder.

In addition, when the oral care refill head 200 is coupled to the handle 100, the second alignment element 150 of the stem 120 nests within the second alignment groove 250 of the oral care refill head 200. Similarly, the first alignment element 160 of the stem 120 nests within the first alignment groove 260 of the oral care refill head 200. This not only ensures that the oral care refill head 200 is initially coupled to the handle 100 in the correct rotational orientation, but also prevents the oral care refill head 200 from being rotated relative to the handle 100 once the oral care refill head 200 is coupled to the handle 100. As noted herein, the oral care refill head 200 cannot be altered from the first state (whereby it is separated from the handle 100) to the second state (whereby it is coupled to the handle 100) unless the first and second alignment elements 150, 160 are circumferentially aligned (i.e., at the same rotational position about the stem and cavity axes A-A, B-B) with the first and second alignment grooves 250, 260.

Furthermore, when the oral care refill head 200 is coupled to the handle 100, the first axial portion 122 of the stem 120 nests within the first axial portion 270 of the sleeve cavity 221. The fourth axial portion 125 of the stem 120 nests within the third axial portion 272 of the sleeve cavity 221. The second and third axial portions 123, 124 of the stem 120 both nest within the second axial portion 271 of the sleeve cavity 221. An interference fit may be achieved between portions of the stem 120 and portions of the sleeve cavity 221 in some embodiments. In particular, portions of the inner surface 227 of the sleeve portion 220 of the oral care refill head 200 may be in contact with portions of the outer surface 149 of the stem 120 to create a friction fit to assist in holding the stem 120 securely in place within the sleeve cavity 221. In some embodiments, this means that there is a pressure, even if ever so slightly, applied by the inner surface 227 of the sleeve portion 220 of the oral care refill head 200 against a part of the outer surface 149 of the stem 120. This interference fit may prevent relative movement (rocking, rattling, shaking, or the like) between the oral care refill head 200 and the handle 100 during use of the oral care implement 1000. In some embodiments, the interference fit formed between the stem 120 and the sleeve cavity 2221 may extend a length that is 25% or more of a total length of the stem 120.

Finally, when the oral care refill head 200 is in the second state and coupled to the handle 100, the proximal edge surface 222 of the sleeve portion 220 of the oral care refill head 200 is adjacent to or abuts the shoulder 116 at the distal end 112 of the gripping portion 110 of the handle 100. More specifically, the proximal edge surface 222 of the sleeve portion 220 of the oral care refill head 200 is in abutment with the annular shoulder surface 116 of the gripping portion 110 of the handle 100. The snap-fit interlock between the sleeve snap element 240 and the lower end surface or downwardly facing shoulder 138 biases or forces the proximal edge surface 222 of the sleeve portion 220 against (into abutment with) the annular shoulder surface 116 of the gripping portion 110 of the handle 100.

The use of a specific numerical value as a prefix for the various angles is not necessarily consistent in the specification and the claims. Rather, the numerical values used in the specification are merely used to distinguish one angle from another. The same is done in the claims, although the prefixes for the angles in the claims are simply listed sequentially as they appear in the claims rather than listed in a way that corresponds with the way that same angle is described in the specification.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. An oral care refill head for detachable coupling to a stem of a handle, the oral care refill head comprising:

an oral care treatment portion; and a sleeve portion comprising:

an inner surface that defines a sleeve cavity extending along a cavity axis;

a sleeve snap element protruding from the inner surface towards the cavity axis and configured to snap-interlock with a stem snap element of the stem;

a first alignment groove formed into the inner surface on a first side of the cavity axis, the first alignment groove extending axially from a first open groove end to a first closed groove end wall, the first closed groove end wall being located axially between the first open groove end and a proximal-most edge of the sleeve snap element and being axially spaced apart from the proximal-most edge of the sleeve snap element by a gap, a second alignment groove formed into the inner surface on a second side of the cavity axis that is opposite the first side of the cavity axis, wherein a first reference plane that is transverse to the cavity axis intersects both the second alignment groove and the sleeve snap element without intersecting the first alignment groove.

2. The oral care refill head according to claim 1 wherein the sleeve portion further comprises a proximal edge surface that defines an opening into the sleeve cavity, and wherein an open groove end of each of the first and second alignment grooves is located at the proximal edge surface.

3. The oral care refill head according to claim 1 wherein the first alignment groove comprises a first length and a first width and wherein the second alignment groove comprises a second length and a second width, the second length being greater than the first length and the second width being greater than the first width.

4. The oral care refill head according to claim 1 wherein the first closed groove end wall is oriented at an oblique angle relative to the cavity axis.

5. The oral care refill head according to claim 1 wherein the first alignment groove comprises a floor that extends along a first alignment groove axis and wherein the second alignment groove comprises a floor that extends along a second alignment groove axis, the first alignment groove axis intersecting the cavity axis at a first angle and the second alignment groove axis intersecting the cavity axis at a second angle that is different than the first angle.

6. The oral care refill head according to claim 5 wherein the first alignment groove axis intersects the sleeve cavity, and wherein the second alignment groove axis does not intersect the sleeve cavity.

7. The oral care refill head according to claim 1 wherein a second closed groove end wall of the second alignment groove is oriented perpendicular to the cavity axis and wherein the first closed groove end wall of the first alignment groove is oriented oblique to the cavity axis.

8. The oral care refill head according to claim 1 wherein the first and second alignment grooves are configured to mate with first and second alignment ribs of the stem of the handle to prevent relative rotation between the handle and the oral care refill head, and wherein the sleeve portion is configured to prevent the stem from being fully inserted into the sleeve cavity unless the first and second alignment ribs of the stem and the first and second alignment grooves of the sleeve portion are circumferentially aligned with one another.

9. The oral care refill head according to claim 1 wherein the oral care treatment portion comprises a plurality of tooth cleaning elements protruding from a head body.

10. The oral care refill head according to claim 1 wherein the sleeve snap element comprises an annular protuberance that protrudes from the inner surface toward the cavity axis, the annular protuberance extending circumferentially around the inner surface of the sleeve portion and comprising a gap that is aligned with the second alignment groove.

11. An oral care refill head for detachable coupling to a stem of a handle, the oral care refill head comprising:

an oral care treatment portion; and a sleeve portion comprising:

an inner surface that defines a sleeve cavity extending along a cavity axis;

a first alignment groove formed into the inner surface on a first side of the cavity axis, the first alignment groove comprising a floor portion that extends along a first groove axis that is oriented at a first angle relative to the cavity axis; and a second alignment groove formed into the inner surface on a second side of the cavity axis that is opposite the first side of the cavity axis, the second alignment groove comprising a floor portion that extends along a second groove axis that is oriented at a second angle relative to the cavity axis, the second angle being less than the first angle, wherein the first groove axis intersects the cavity axis at a location within the sleeve cavity, and wherein the second groove axis does not intersect the sleeve cavity.

12. The oral care refill head according to claim 11 wherein the sleeve portion further comprises a proximal edge surface that defines an opening into the sleeve cavity, wherein the first alignment groove extends axially from a first open groove end in the proximal edge surface of the sleeve portion to a first closed groove end wall and wherein the second alignment groove extends axially from a second open groove end in the proximal edge surface of the sleeve portion to a second closed groove end wall.

13. The oral care refill head according to claim 12 wherein the first closed groove end wall is oriented at an oblique angle relative to the cavity axis and wherein the second closed groove end wall is oriented perpendicular to the cavity axis.

14. The oral care refill head according to claim 13 wherein the oblique angle is a greater angle than the first and second angles, and wherein the first closed groove end wall forms an obtuse angle with the floor portion of the first alignment groove.

15. The oral care refill head according to claim 11 wherein the first alignment groove comprises a first length and a first width and wherein the second alignment groove comprises a second length and a second width, the second length being greater than the first length and the second width being greater than the first width.

16. The oral care refill head according to claim 11 further comprising a sleeve snap element protruding from the inner surface towards the cavity axis and configured to snap-interlock with a stem snap element of the stem, the sleeve snap element extending circumferentially around the inner surface of the sleeve portion and having a gap that is aligned with the second alignment groove.

17. The oral care refill head according to claim 16 wherein the second alignment groove is axially aligned with the sleeve snap element and the first alignment groove is located entirely between the sleeve snap element and a proximal edge surface of the sleeve portion.

18. An oral care refill head for detachable coupling to a stem of a handle, the oral care refill head comprising:

an oral care treatment portion comprising a plurality of tooth cleaning elements; and a sleeve portion comprising:

an inner surface that defines a sleeve cavity extending along a cavity axis;

a sleeve snap element positioned along the inner surface and configured to engage a stem snap element of the stem; and a single continuous alignment groove configured to receive a first alignment rib and a second alignment rib of the stem that are positioned 180° apart from one another, the single continuous alignment groove comprising a first portion located on a first side of the cavity axis for receiving the first alignment rib and a second portion located on a second side of the cavity axis for receiving the second alignment rib.

19. The oral care refill head according to claim 2 wherein the oral care treatment portion comprises a plurality of tooth cleaning elements protruding from a head body, and wherein the proximal edge surface of the sleeve portion extends radially from an outer sleeve edge to an inner sleeve edge, the proximal edge surface inclined from the inner sleeve edge to the outer sleeve edge in one direction downwardly away from the oral care treatment portion with increasing distance from the cavity axis.

20. The oral care refill head according to claim 18 wherein the sleeve snap element comprises an annular protuberance that protrudes from the inner surface toward the cavity axis, the annular protuberance extending circumferentially around the inner surface of the sleeve portion and comprising a gap that is aligned with the second portion of the single continuous alignment groove.

* * * * *